United States Patent [19]

Ishikawa

[11] Patent Number: 4,939,074

[45] Date of Patent: Jul. 3, 1990

[54] METHOD FOR PROCESSING SILVER HALIDE COLOR PHOTOGRAPHIC LIGHT-SENSITIVE MATERIAL

[75] Inventor: Takatoshi Ishikawa, Minami-Ashigara, Japan

[73] Assignee: Fuji Photo Film Co., Ltd., Minami-Ashigara, Japan

[21] Appl. No.: 186,232

[22] Filed: Apr. 26, 1988

[30] Foreign Application Priority Data

Apr. 28, 1987 [JP] Japan ..... 62-105627

[51] Int. Cl.[5] ..... G03C 7/42

[52] U.S. Cl. ..... 430/393; 430/337; 430/372; 430/386; 430/387; 430/398; 430/399; 430/400; 430/430

[58] Field of Search ..... 430/393, 400, 430, 386, 430/387, 337, 372, 398, 399

[56] References Cited

U.S. PATENT DOCUMENTS

| | | | |
|---|---|---|---|
| 4,351,897 | 9/1982 | Aoki et al. | 430/551 |
| 4,366,233 | 12/1982 | Nakamura | 430/393 |
| 4,540,654 | 9/1985 | Sato et al. | 430/385 |
| 4,621,046 | 11/1986 | Sato et al. | 430/381 |
| 4,681,835 | 7/1987 | Ishikawa et al. | 430/386 |
| 4,752,556 | 6/1988 | Kishimoto | 430/398 |
| 4,756,918 | 7/1988 | Ueda et al. | 430/393 |
| 4,762,774 | 8/1988 | Kishimoto et al. | 430/430 |
| 4,780,403 | 10/1988 | Kishimoto et al. | 430/567 |
| 4,789,626 | 12/1988 | Sakanoue et al. | 430/393 |
| 4,798,784 | 1/1989 | Kishimoto et al. | 430/382 |

FOREIGN PATENT DOCUMENTS

| | | |
|---|---|---|
| 199604 | 10/1986 | European Pat. Off. . |
| 2078988 | 1/1982 | United Kingdom . |
| 2165954 | 4/1986 | United Kingdom . |

*Primary Examiner*—Paul R. Michl
*Assistant Examiner*—Hoa Van Le
*Attorney, Agent, or Firm*—Burns, Doane, Swecker & Mathis

[57] ABSTRACT

A method for processing a silver halide color photographic light-sensitive material which comprises color developing a silver halide color photographic light-sensitive material, the coating amount of elemental silver thereon being not more than 0.8 g/m$^2$, bleach-fixing the developed material and then water washing and/or stabilizing the bleach-fixed material, the method being characterized in that the concentration of bleaching agents in a bleach-fixing solution is not more than 0.1 mole/l or that of fixing agents in the solution is not more than 0.50 mole/l.

9 Claims, No Drawings

METHOD FOR PROCESSING SILVER HALIDE COLOR PHOTOGRAPHIC LIGHT-SENSITIVE MATERIAL

FIELD OF THE INVENTION

The present invention relates to a method for processing silver halide color photographic light-sensitive materials and more specifically to a method for processing silver halide photographic light-sensitive materials which is excellent in desilvering properties and enables maintenance of high quality.

BACKGROUND OF THE INVENTION

In methods for processing silver halide color photographic light-sensitive materials, it has been desired to simplify, speed up and stabilize the processing and many improved methods have been proposed. However, none of the proposed methods offers a complete solution.

Particularly, speeding up of such processing serves to reduce the time required to finish color photographs and thus many techniques have been reported. These are directed to the speeding up of such processes as color developing, desilvering and water washing.

The purpose of the present invention is to improve the desilvering speed in the desilvering process, in particular in the bleach-fixing treatment. The most commomly used means for speeding up the bleach-fixing process is to employ a desilvering accelerator and a variety of techniques directed to such an accelerator have been proposed. For instance, as such desilvering accelerator there have, for example, been used compounds having mercapto or disulfide groups; thiazolidine derivatives; thiourea derivatives; iodides; polyethylene oxides; and polyamine compounds.

However, in a low silver content light-sensitive material such as color paper, on which the coating amount of silver is not more than 0.8 g/m$^2$, it is found that the foregoing developing accelerator actually lowers the bleaching rate and, therefore, such a solution is not preferable in this case. Another generally used method for speeding up the desilvering process is to increase the concentration of bleaching and fixing agents. For example, the bleaching agent is generally used in an amount of not less than 0.13 M and the fixing agent in an amount of not less than 0.60 M. In fact, this method is an effective means for processing light-sensitive materials whose coating amount of silver is not less than 0.9 g/m$^2$. However, it is not effective for processing the low silver content light-sensitive materials with which the present invention is concerned, and on the contrary, it is found that the method results in the lowering of the desilvering rate.

On the other hand, pyrazoloazole type magenta couplers are known and disclosed in various articles such as Japanese Patent Un-examined Publication (hereinafter referred to as "J.P. KOKAI") Nos. 59-162548, 60-43659, 59-171956, 60-172982 and 60-33552 and U.S. Pat. No. 3,061,432 and a various studies have been made regarding these couplers owing to their excellent color phase. Moreover, pyrazolone magenta couplers are also known to be excellent in light fastness, or disclosed in Japanese Patent Publication for Opposition Purpose (hereinafter referred to as "J.P. KOKOKU") No. 53-34044 and J.P.KOKAI Nos. 55-62454 and 57-35858.

However, if light-sensitive materials containing these magenta couplers are processed in desilvering or water washing and/or stabilization processes in which the processing time is reduced or the amount of washing water used is substantially reduced, it is found that magenta stains are liable to occur with passage of time. Therefore, various methods have been investigated to solve such problem.

However, the use of the conventional antidiscoloring or stain resistant methods was not found to be an effective solution to the problem. In this connection, reference is made to U.S. Pat. No. 2,360,290, U.K. Pat. No. 1,363,921 and J.P. KOKAI No. 58-24141, which disclose the use of hydroquinone derivatives; U.S. Pat. No. 3,457,079, which discloses gallic acid derivatives; U.S. Pat. No. 2,735,765 and J.P. KOKOKU No. 52-6623, which disclose p-alkoxyphenols; U.S. Pat. No. 3,432,300 and J.P. KOKAI No. 52-35633, which disclose p-oxyphenol derivatives; U.S. Pat. No. 3,700,455, which discloses bisphenols for antidiscoloring techniques; and J.P. KOKAI No. 49-11330 and J.P. KOKOKU No. 56-8346 for stain resistant techniques.

As discussed above, there has been a need for the development of techniques which make it possible to eliminate the foregoing drawbacks associated with the use of the aforementioned magenta couplers.

SUMMARY OF THE INVENTION

An object of the present invention is to provide a method for processing color photographic light-sensitive materials having a low silver content without impairing or lowering desilvering properties.

It is another object of the invention to provide a method for processing such light-sensitive materials which makes it possible to eliminate magenta stains.

It is a still another object of the invention to provide a method for processing such light-sensitive materials, which provides good color images even when the amount of washing water or stabilization solution is substantially reduced.

Other objects of the present invention will be apparent from the description given below.

The inventor of the present invention has conducted various studies and found that the objects of the invention can effectively be accomplished by utilizing the following means.

According to the present invention, there is provided a method for processing a silver halide color photographic light-sensitive material which comprises color developing a silver halide color photographic light-sensitive material, the coating amount of silver thereon being not more than 0.8 g/m$^2$, bleach-fixing the developed material and then water washing and/or stabilizing the bleach-fixed material, the method further comprises that the concentration of bleaching agents in the bleach-fixing solution is not more than 0.1 mole/1 or that of fixing agents in the solution is not more than 0.5 mole/1.

Unexpectedly, the desilvering speed in the processing of silver halide color photographic light-sensitive materials having a low silver content as in the present invention can be extremely enhanced by reducing the concentration of bleaching and/or fixing agents, preferably the concentration of both agents, when desilvering the materials after color development. A further noteworthy finding is that a pronounced reduction of magenta stains is observed without lowering desilvering properties when the bleach-fixing solutions of the present invention are used together with magenta couplers represented by the general formula (I) or (II), as will be explained below.

DETAILED DESCRIPTION OF THE INVENTION

The silver halide color photographic light-sensitive materials according to the present invention will hereunder be explained in more detail.

The coating amount of silver in the light-sensitive materials to be treated by the method of this invention is preferably as low as possible so as to speed up of the desilvering process and the upper limit thereof is 0.8 $g/m^2$. The preferred amount thereof ranges from 0.20 to 0.50 $g/m^2$.

The silver halides as used herein may be any of silver chloride, silver bromide and silver iodide. However, silver chlorobromide which is substantially free from silver iodide is particularly preferred. The term "substantially free from silver iodide" means that the content of silver iodide is not more than 3 mole%, preferably not more than 1 mole%, more preferably not more than 0.5 mole% and most preferably zero, with respect to the total amount of silver halide. The use of silver iodide provides a variety of advantages such that the amount of light absorbed is increased in view of sensitivity, that the amount of spectral sensitizing dye adsorbed is improved and that the lowering of the sensitivity due to spectral sensitizing dye is prevented and thus, in some cases, the use thereof in a small amount, for instance, not more than 1 mole% or particularly not more than 0.2 mole% is preferred to the use of materials that are totally free from silver iodide. Even in such a case, the development speed of light-sensitive materials including silver iodide is, of course, lowered due to the presence thereof compared with that observed in the development of those including silver chloride or silver bromide. Thus, in the present invention, silver halide emulsions substantially free from silver iodide are preferably used. However, it may be effective to incorporate a small amount of silver iodide in cases where the foregoing effects of silver iodide are desirable.

In the present invention, silver chlorobromide of any compositions may be used and, therefore, it may be pure silver chloride, pure silver bromide or silver chlorobromides having any intermediate compositions. Moreover, these may further include a small amount of silver iodide.

The silver halide emulsion preferably used herein is silver chlorobromide emulsions having a silver bromide content of not less than 10 mole%. The content of silver bromide is preferably not less than 20 mole% to obtain an emulsion exhibiting a sufficient sensitivity without increasing fogging, while it is optionally preferred to use it in an amount of not more than 20 mole% or not more than 10 mole% when a rapid processing is required.

In systems to which the method of this invention is applied, in particular in cases where the speeding up of the color development is required, it is further preferred to use silver chloride substantially free from silver bromide i.e., that having a silver bromide content of preferably not more than 3 mole%, more preferably not more than 1 mole%.

The use of silver halide emulsion having low silver bromide content makes it possible not only to speed up the development but to establish high developing properties with respect to the developer per se since when the development of light-sensitive materials obtained from such an emulsion is conducted in a processing solution, bromide ions are present in the developer in a small amount (equilibrium accumulated amount) which is determined by the relation between the developer in a bath and that replenished thereto.

It is desirable that the silver bromide content in the emulsion be further increased to obtain light-sensitive materials which cause almost no fogging and exhibit stable gradation. Thus the silver bromide content is preferably not less than 50 mole%. Further, a very stable emulsion can be obtained when the content of silver bromide is not less than 65 mole%. When it exceeds 95 mole%, the developing rate is somewhat lowered. However, this problem is effectively solved by selecting and using silver halide grains having a proper crystalline form, for instance, tabular grains or by using a development accelerator such as 3-pyrazolidones, thioethers and hydrazines, whereby light-sensitive materials having high sensitivity and high stability during storage and processing can be obtained.

The developing properties of silver halide emulsion is determined not only by the halogen composition of the silver halide grains used therein as a whole but also by the halogen atom distribution in each grain. Therefore, each silver halide grain in such emulsions used in the invention may have a distribution of the halogen composition or various crystalline structures. Typical examples thereof are core-shell type or double-structure type grains in which the halogen composition is different between the inner part and outer part. In these grains, the shape of the core and the shape of the grain per se inclusive of the shell may be the same or different. Specifically, if the shape of the core is cubic, the shape of the grain may be cubic or octahedron. On the contrary, if the shape of the core is octahedron, the shape of the grain may be cubic or octahedron. In addition, the shape of the core may be a complete regular crystal form while that of the grain may be slightly deformed or amorphous. The grains may be in triple structure or a higher structure or the grains having core-shell double structure may be enclosed with a thin layer of silver halide having a different composition.

The grains having internal crystalline structure may be formed by joining grains having different crystal forms to obtain those having so-called contact structure therein. The junction therebetween may be caused at the edge, corner or face of a host crystal by forming a crystal different from that of the host crystal. In this case, the host crystal may be uniform with respect to the halogen composition or may have crystal structure such as core-shell structure. In a grain having such structure, for instance, a core-shell type grain, the content of silver bromide may be high at the core while it may be low at the shell or vice versa. Similarly, as to the grain having contact structure, the silver bromide content of the host crystal may be high while that of the contact crystal may be reletively low or vice versa.

The interface between the different crystal forms in the grains having internal crystal structure may be a distinct interface, a indistinct one resulting from the formation of mixed crystals due to difference in composition or one exhibiting a continuous structural change.

In the invention, emulsions comprised of grains having the abovementioned structures rather than those having uniform halogen compositions are preferably used. Particularly preferred are those containing grains having a silver bromide content at the surface portion thereof lower than that at the inner portion thereof.

Typical examples thereof are those comprising core-shell type grains in which the silver bromide content is higher at the core portion than at the shell portion. The molar ratio of silver halide of the core portion to that of the shell portion may be between 0:100 and 100:0 and preferably ranges from 3:97 to 98:2 to enjoy the effect resulting from the use of such core-shell type grains. When shell portion is formed by so-called halogen exchange techniques using the difference between solubilities of silver halides due to difference in halogen species and, in particular, silver chloride is subjected to halogen-exchange with a water-soluble bromide, the core-to-shell ratio is preferably less than 98:2 and particularly not more than 99:1. In this connection, it is practically difficult to uniformly form a shell on a core by the halogen exchange technique while the shell is easily formed at the corner and edge portions of the core. Such halogen-exchanged grains may be subjected to Ostwald ripening to make the halogen distribution uniform. In the emulsions used in this invention, grains either before and after Ostwald ripening may preferably be employed.

When systems containing core-shell type silver halide grains are processed in accordance with the present invention, the preferred molar ratio of silver halide present in the core to that in the shell ranges from 5:95 to 95:5, more preferably 7:93 to 90:10 and most preferably 15:85 to 80:20.

The difference between silver bromide contents of the core and the shell depends on the molar ratio of silver halide present in the core to that in the shell. However, it is preferably 3 to 95 mole%, more preferably 5 to 80 mole% and most preferably 10 to 70 mole%. In general, if the difference in the content is very low, the properties of the resulting emulsions are similar to those observed on the emulsions containing grains of uniform structure while if it is extremely large, problems arise regarding properties. Therefore, since proper difference in composition depends on the molar ratio of core to shell, it is preferable to increase the difference as the molar ratio approaches 0:100 or 100:0, while it is preferred to reduce the difference as the ratio approaches 1:1.

The crystal form of silver chlorobromide used in the invention may also be tetradecahedron, rhombododecahedron or other crystal forms in addition to the aforementioned ones. Particularly, grains having conjugated crystal structure may be in a regular crystal form in which the conjugated crystals are uniformly formed at corners, edges or faces of the host crystal and the grain is not amorphous. The grains may be spherical. The octahedral grains are preferably used in the invention and in particular the cubic grains are preferable. The tabular grains may also be used and particularly excellent rapid developing properties are exhibited by emulsions in which not less than 50 mole% of the projected areas of whole grains contained is accounted for by tabular grains having a diameter (of a circle having the same area as the projected area of the plate) /thickness ratio ranging from 5 to 8. As to such tabular grains, those having the abovementioned crystal structures are preferred.

The average size of the silver halide grains used herein preferably ranges from 0.1 to 2 microns and more preferably 0.15 to 1.4 microns expressed as the averaged diameter of spheres having the same volume as those of the grains.

The grain size distribution may be either wide or narrow. However, emulsions are preferably monodisperse ones, and monodisperse emulsions containing grains having regular crystal forms or tabular grains are particularly preferred. Emulsions containing grains of which not less than 85%, particularly not less than 90%, based on the number or weight thereof fall within the range of the average grain size ± 20% are preferred. Particularly preferred results are obtained by using a mixture of at least two such emulsions, in particular monodisperse emulsions containing cubic, octahedral or tetradecahedral grains or by coating such emulsions in multilayered state.

The silver halide grains may be coexistent with other compounds such as cadmium salts, zinc salts, lead salts, thallium salts, iridium salts or complex salts thereof, rhodium salts or complex salts thereof, or iron salts or complex salts thereof during formation of grains or the physical ripening process thereof.

Among these, the iridium salts and complex salts thereof are preferably used in an amount of $10^{-9}$ to $10^{-4}$ mole and more preferably $10^{-8}$ to $10^{-5}$ mole per mole of silver halide. Compared with emulsions prepared without using iridium salts or complex salts thereof, emulsions containing them are particularly preferred to impart, to the resultant light-sensitive material, rapid developing properties and high stability at high or low illuminance outside the proper exposure illuminance range.

The physical ripening process is preferably carried out in the presence of a known solvent for silver halide such as ammonia, potassium thiocyanate or thioethers and thion compounds as disclosed in U.S. Pat. No. 3,271,157 and J.P. KOKAI Nos. 51-12360, 53-82408, 53-144319, 54-100717 and 54-155828 and thus a monodisperse emulsion containing grains having regular crystal forms and a narrow size distribution can be obtained.

The silver halide emulsions used in the invention may be chemically sensitized by, for instance, sulfur or selenium sensitization, reduction sensitization or noble metal sensitization, which may be employed alone or in combination. In the sulfur sensitization, there may be used sulfur containing compounds reactive with active gelatin or silver ions, such as thiosulfates, thiourea compounds, mercapto compounds or rhodanine compounds; in the reduction sensitization, stannous salts, amines, hydrazine derivatives, formamidinesulfinic acid or silane compounds may be used; and in the noble metal sensitization, metal compounds such as gold complex salts and complex salts of Group VIII metals of Periodic Table (e.g., Pt, Ir, Pd, Rh and Fe) may be used. The silver chlorobromide in the invention is preferably sensitized through sulfur or selenium sensitization and further the sensitization is preferably carried out in the presence of a hydroxyazaindene compound.

The photographic emulsions used in the invention may be prepared by the method disclosed in Research Disclosure (RD) Vol. 170, No. 17643 (Item I, II, III) (December, 1978).

The emulsions used in the invention are in general physically ripened, chemically ripened and spectrally sensitized before use. Additives usable in these processes are disclosed in Research Disclosure, Vol. 176, No. 17643 (December, 1978) and ibid, Vol.176 No. 18716 (November, 1979) of which relevant parts are summarized in the following Table.

Additives for photographs are also disclosed in the foregoing two articles (Research Disclosure) and the relevant parts thereof are likewise listed in the following Table:

| Kind of Additive | RD 17643 | RD 18716 |
|---|---|---|
| 1. Chemical sensitizer | p 23 | p 648, right col. |
| 2. Sensitizer | " | p 648, right col. |
| 3. Spectral sensitizer | p 23–24 | p 648, right col. to p 649, right col. |
| 4. Supersensitizer | " | p 648, right col. to p 649, right col. |
| 5. Whitener | p 24 | |
| 6. Antifoggant, stabilizer | p 24–25 | p 649, right col. |
| 7. Coupler | p 25 | p 649, right col. |
| 8. Organic solvent | p 25 | p 649, right col. |
| 9. Light absorber, filter dye | p 25–26 | p 649, right col. to p 650, left col. |
| 10. Ultraviolet absorber | " | p 649, right col. to p 650, left col. |
| 11. Antistaining agent | p 25, | p 650, left to right col. |
| 12. Dye image stabilizer | p 25 | p 650, left to right col. |
| 13. Hardening agent | p 26 | p 651, left col. |
| 14. Binder | " | p 651, left col. |
| 15. Plasticizer, lubricant | p 27 | p 650, right col. |
| 16. Coating aid, surfactant | p 26–27 | p 650, right col. |
| 17. Antistatic agent | p 27 | p 650, right col. |

Various couplers may be used in the invention. The term "color coupler(s)" as used herein means compounds capable of forming dyes through a coupling reaction with an oxidized form of an aromatic primary amine developing agent. Typical examples of color couplers useful in the invention include naphtholic or phenolic compounds, pyrazolone or pyrazoloazole type compounds and linear or heterocyclic ketomethylene compounds. Specific examples of these cyan-, megenta- and yellow-couplers usable in the invention are disclosed in the patents cited in Research Disclosure No. 17643 (December, 1978), VII-D; and No. 18717 (November, 1979).

Color couplers included in the light-sensitive materials are preferably made non-diffusible by imparting thereto ballast groups or polymerizing them. 2-equivalent type color couplers in which the active site for coupling is substituted with an elimination group is more preferable than 4-equivalent type color couplers in which the active site for coupling is hydrogen atom. This is because the amount of coated silver may thereby be reduced. Moreover, couplers in which a formed dye has a proper diffusibility, non-color couplers, DIR couplers which can release a development inhibitor through the coupling reaction or couplers which can release a development accelerator may also be used.

Typical yellow couplers usable in the invention are acylacetamide couplers of an oil protect type. Examples of such yellow couplers are disclosed in U.S. Pat. Nos. 2,407,210, 2,875,057 and 3,265,506. 2-equivalent type yellow couplers are preferably used in the invention. Typical examples thereof are the yellow couplers of an oxygen atom elimination type disclosed in U.S. Pat. Nos. 3,408,194, 3,447,928, 3,933,501 and 4,022,620, or the yellow couplers of a nitrogen atom elimination type described in J.P. KOKOKU No. 55-10739, U.S. Pat. Nos. 4,401,752 and 4,326,024, Research Disclosure No. 18053 (April, 1979), U.K. Pat. No. 1,425,020, DEOS Nos. 2,219,917, 2,261,361, 2,329,587 and 2,433,812. Alpha-pivaloyl acetanilide type couplers are excellent in fastness, particularly light fastness, of formed dye. On the other hand, alpha-benzoyl acetanilide type couplers yield high color density.

Magenta couplers usable in the present invention include couplers of an oil protect type of indazolone, cyanoacetyl, or, preferably, pyrazoloazole type ones such as 5-pyrazolones and pyrazolotriazoles. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082, 2,343,703, 2,600,788, 2,908,573, 3,062,653, 3,152,896 and 3,936,015.

Particularly, the use of the magenta couplers represented by the following general formula (I) or (II) are extremely preferred since the coating amount of silver can thereby be reduced and the coloring property of the light-sensitive materials can also be improved, while the problem that magenta stains are likely to occur after processing, which is a drawback of the both couplers, can be simultaneously solved.

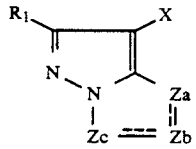

(I)

wherein $R_1$ represents a hydrogen atom or a substituent; X represents a hydrogen atom or a group which may be eliminated through a coupling reaction with an oxidized form of an aromatic primary amine developing agent; Za, Zb and Zc represent a methine, a substituted methine, =N— or —NH—, provided that one of the bonds Za-Zb and Zb-Zc is a double bond and the other is a single bond, that when Zb-Zc bond is a carbon-carbon double bond, Zb-Zc may be a part of an aromatic ring; that a dimer or a higher polymer may be formed through $R_1$ or X and that when Za, Zb or Zc is a substituted methine, a dimer or a higher polymer may be formed through the substituted methine;

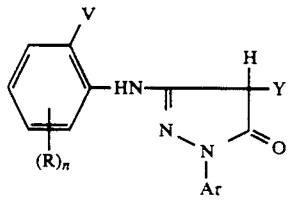

(II)

wherein Ar is a phenyl group which may be substituted; Y represents a group which is eliminated when the coupler causes coupling reaction with an oxidized form of an aromatic primary amine developing agent to form a dye; V is a halogen atom, an alkoxy group or an alkyl group; R represents a group which may be substituted for a hydrogen atom on a benzene ring provided that when n is 2, R may be the same or different; and n is an integer of 1 or 2.

The magenta couplers represented by the formula (I) will hereunder be explained in more detail.

In the formula (I), $R_1$ represents a hydrogen atom or a substituent; X represents a hydrogen atom or a group which may be eliminated through a coupling reaction with an oxidized form of an aromatic primary amine developing agent; Za, Zb and Zc represent a methine, a substituted methine, =N— or —NH—, provided that one of the bonds Za-Zb and Zb-Zc is a double bond and the other is a single bond, that when Zb-Zc bond is a carbon-carbon double bond, Zb-Zc may be a part of an aromatic ring; that a dimer or a higher polymer may be form through $R_1$ or X and that when Za, Zb or Zc is a substituted methine, a dimer or a higher polymer may be formed through the substituted methine.

In the formula (I), the term "higher polymer" means those having not less than 2 groups represented by the general formula (I) per molecule and includes dimeric and polymeric couplers. The "polymeric couplers" may be homopolymers simply composed of the monomeric units having the moiety represented by the formula (I) (preferably those having vinyl group, hereunder referred to as "vinyl monomer") or a copolymers thereof with non-coloring ethylenically unsaturated monomers which do not cause coupling reaction with the oxidized product of the aromatic primary amine developing agent.

The compounds represented by the formula (I) are 5-membered ring/5-membered ring condensed nitrogen-containing heterocyclic couplers and the coloring nucleus thereof exhibits aromaticity electrically equivalent to naphthalene. The compounds have a structure known generically as azapentalene. Preferred examples of the compounds represented by the formula (I) are 1H-imidazo(1,2-b)pyrazoles, 1H-pyrazolo(1,5-b)pyrazoles, 1H-pyrazolo(5,1-c)(1,2,4)triazoles, 1H-pyrazolo(1,5-b)(1,2,4)triazoles, 1H-pyrazolo(1,5-d)tetrazoles, and 1H-pyrazolo(1,5-a)benzimidazoles which are respectively represented by the following general formulas (Ia), (Ib), (Ic), (Id), (Ie), and (If). Particularly preferred compounds are those represented by the formulas (Ia), (Ic) and (Id) and more preferred one is compound (Id).

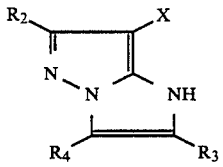

(Ia)

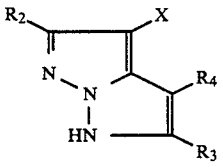

(Ib)

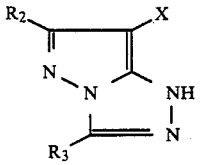

(Ic)

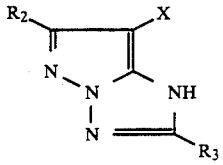

(Id)

-continued

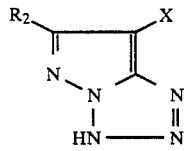

(Ie)

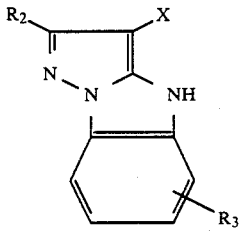

(If)

In the general formulas (Ia) to (If), the substituents $R_2$ to $R_4$ may be the same or different and independently represent a hydrogen atom, a halogen atom, an alkyl group, an aryl group, a heterocyclic group, a cyano group, an alkoxy group, an aryloxy group, a heterocyclic oxy group an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; X is a group being able to be eliminated through the coupling reaction and represents a hydrogen atom, a halogen atom, a carboxyl group, or a group which is bonded to the carbon atom at the coupling position, through an oxygen, nitrogen or sulfur atom.

$R_2$, $R_3$, $R_4$ or X may be a bivalent group to form bisforms. Moreover, when the part represented by one of the formulas (Ia) to (If) is a moiety of a vinyl monomer, one of $R_2$ to $R_4$ represents a single bond or a connecting group through which the vinyl group and the moiety represented by one of the formulas (Ia) to (If) are bonded together.

More specifically, $R_2$ to $R_4$ may be the same or different and independently represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

X represents a hydrogen atom, a halogen atom, a carboxyl group, a group bonded to the ring through an oxygen atom, such as an acetoxy group, a propanoyloxy group, a benzoyloxy group, an alpha-naphthoxy group or a 2-benzothiazolyloxy group; a group bonded thereto through a nitrogen atom, such as a benzenesulfonamido group, an N-ethyltoluenesulfonamido group, a 1-benzyl-ethoxy-3-hydantoinyl group, or a 2-hydroxy-4-propanoylphenylazo group; or a group bonded thereto through a sulfur atom such as a phenylthio group, a 2-carboxyphenylthio group, a 2-butoxy-5-tert-octylphenylthio group, a 4-methanesulfonamidophenylthio group, a benzylthio group, or a 2-phenyl-3-dodecyl-1,2,4-triazolyl-5-thio group.

When one of $R_2$ to $R_4$ and X is a bivalent group to form abis-form specific examples of such bivalent groups are a substituted or unsubstituted alkylene group, a substituted or unsubstituted phenylene group or a group represented by the formula —NHCO—$R_5$—CONH—(wherein $R_5$ is a substituted or unsubstituted alkylene or phenylene group).

When the part represented by one of the formulas (Ia) to (If) is the moiety of a vinyl monomer, the connecting group represented by one of $R_2$ to $R_4$ is a group obtained by combining the groups selected from the group consisting of substituted or unsubstituted alkylene or substituted or unsubstituted phenylene group, —NHCO—, —CONH—, —O—, —OCO—and aralkylene groups.

The vinyl monomers may have substituents other than those represented by the formulas (Ia) to (If). Preferred examples of such substituents are hydrogen atom, chlorine atom, or a lower alkyl group having 1 to 4 carbon atoms.

Examples of the monomers which do not cause coupling reaction with the oxidized product of an aromatic primary amine developing agent are acrylic acid, alpha-chloroacrylic acid, alpha-alacrylic acid and esters or amides derived from these acrylic acids (such as acrylamide, butylacrylamide, diacetone acrylamide, methacrylamide, methyl acrylate, acrylates, butyl acrylate, beta-hydroxymethacrylate, methylane-di-bis(acrylamide)), vinyl esters (such as vinyl acetate, vinyl propionate and vinyl laurate), acrylonitrile, methacrylonitrile, aromatic vinyl compounds (such as styrene and derivatives thereof, vinyl toluene, divinylbenzene, vinylacetophenone and sulfostyrene), itaconic acid, citraconic acid, crotonic acid, vinylidene chloride, vinyl alkyl ether (such as vinyl ethyl ether), maleic acid, maleic anhydride, maleates, N-vinyl-2-pyrrolidone, N-vinylpyridine and 2- and 4-vinylpyridine, which may be used alone or in combination.

Examples of the couplers represented by the formulas (Ia) to (If) and methods for preparing these are disclosed in the following articles.

Compounds (Ia) are disclosed in, for instance, J.P. KOKAI No. 59-162548; compounds (Ib) in J.P. KOKAI No. 60-43659; compounds (Ic) in J.P. KOKOKU No. 47-27411; compounds (Id) in J.P. KOKAI Nos. 59-171956 and 60-172982; compounds (Ie) in J.P. KOKAI No. 60-33552; and compounds (If) in U.S. Pat. No. 3,061,432.

The ballast groups exhibiting high coloring property disclosed in J.P. KOKAI Nos. 58-42045, 59-214854, 59-177553, 59-177544 and 59-177557 may be applied to any of compounds (Ia) to (If).

Specific examples of the pyrazoloazole type couplers used in the invention will be listed below, however, the invention is not restricted to these specific examples at all.

M-1

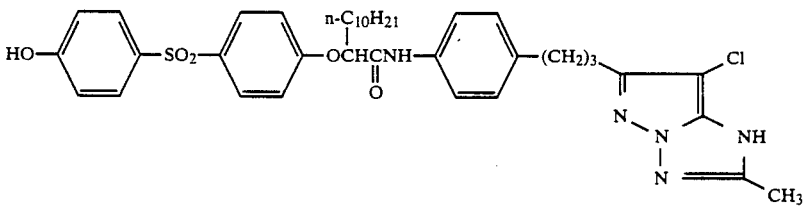

M-2

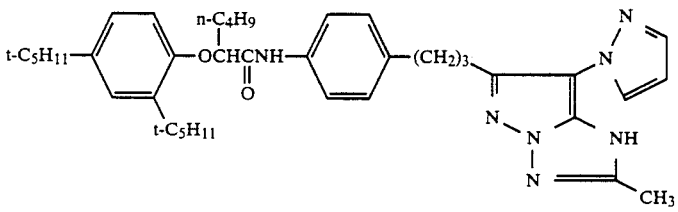

M-3

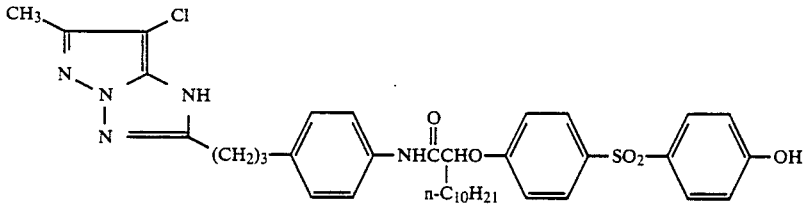

M-4

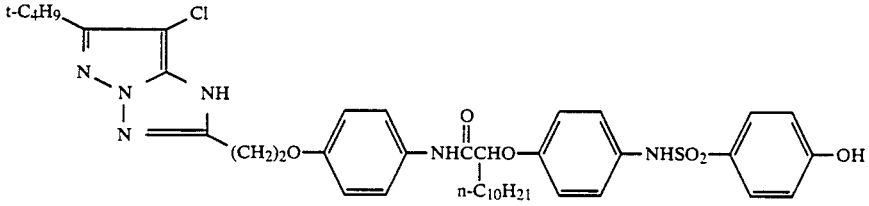

-continued
M-5
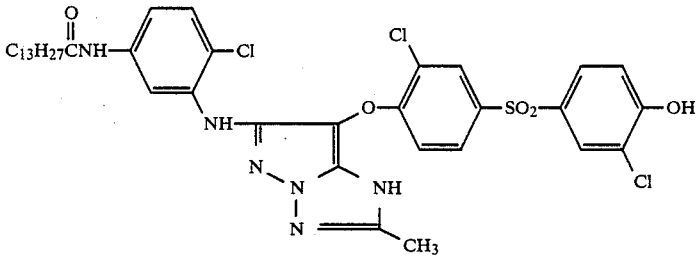
M-6
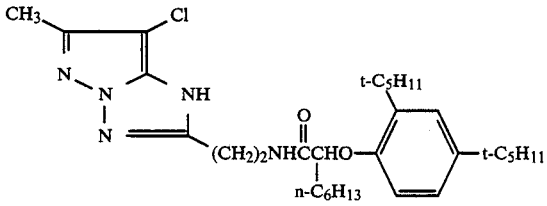
M-7
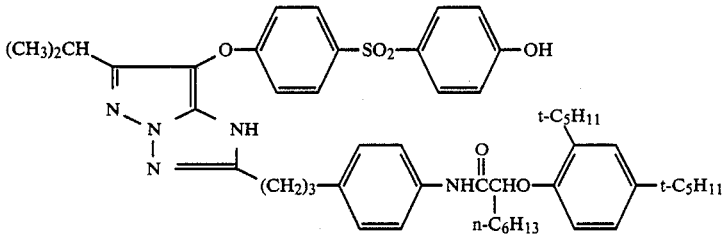
M-8
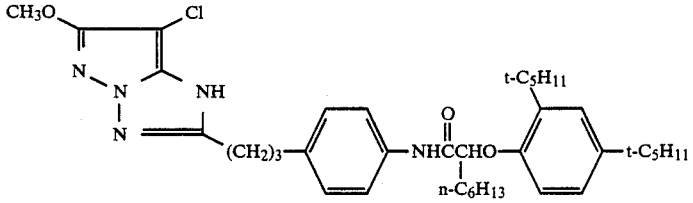
M-9
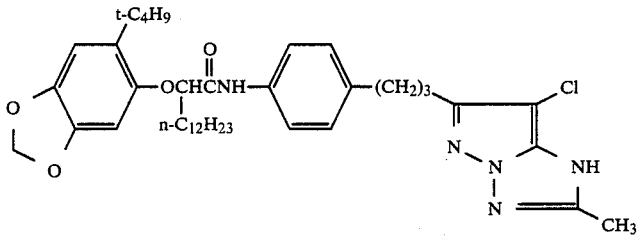
M-10
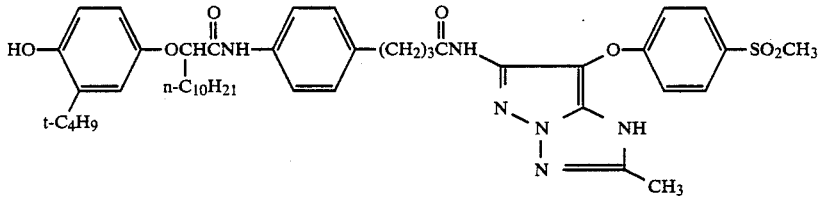
M-11
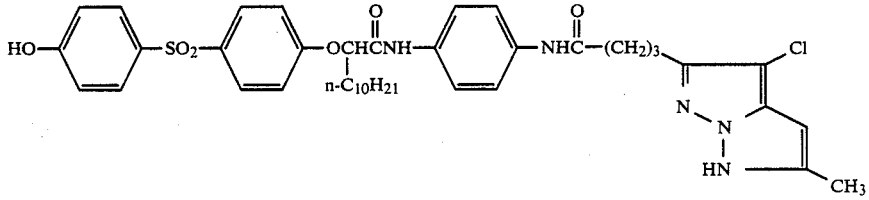

-continued
M-12
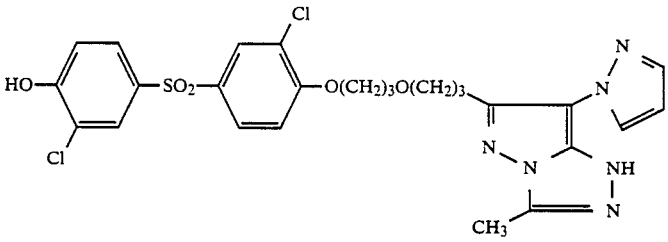
M-13
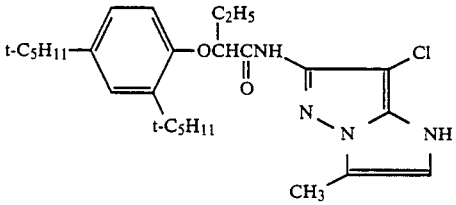
M-14
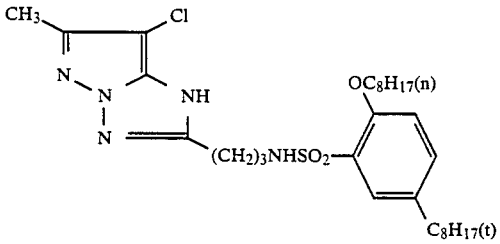
M-15
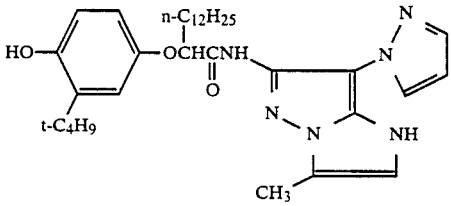
M-16
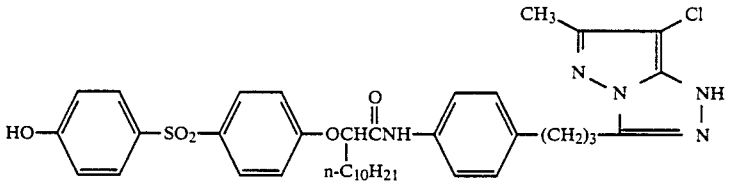
M-17
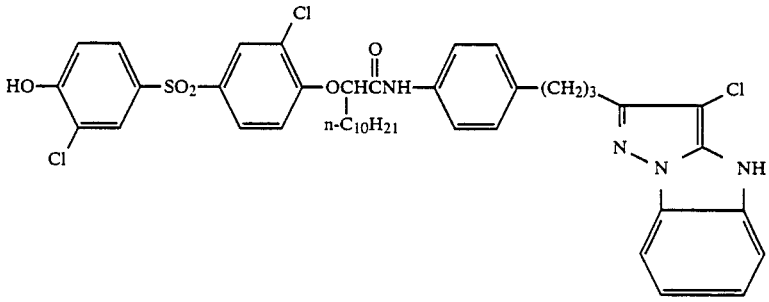

-continued
M-18
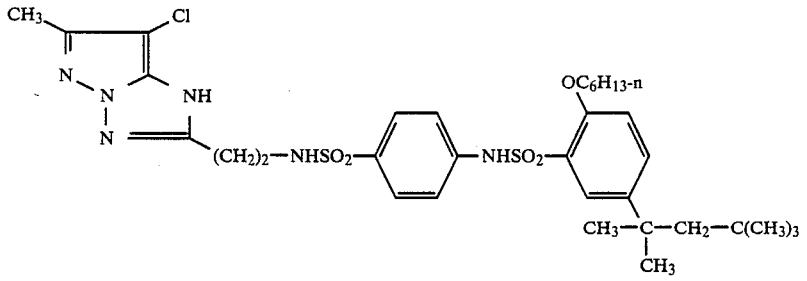
M-19
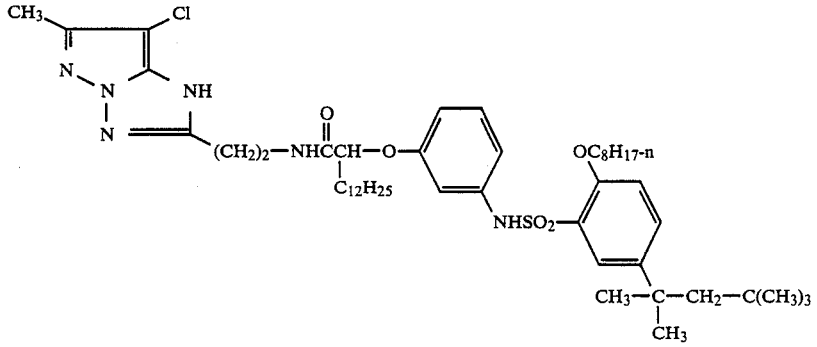
M-20
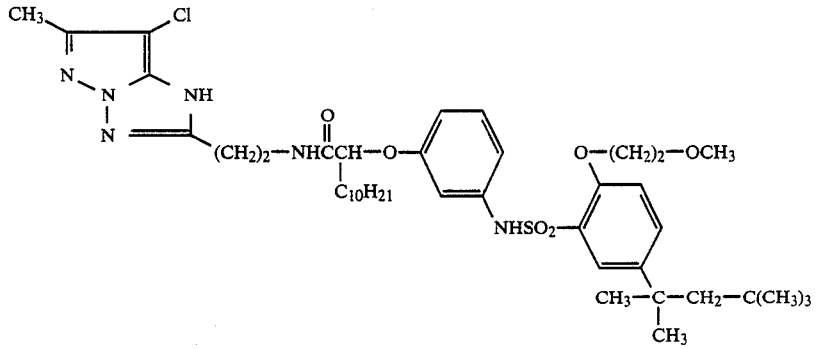
M-21
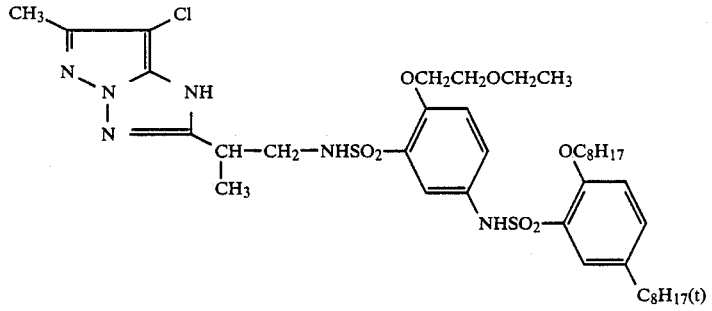
M-22
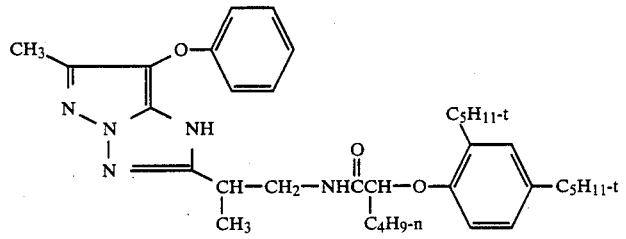

-continued
M-23
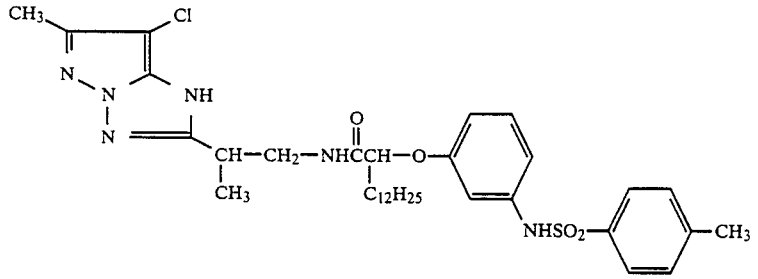
M-24
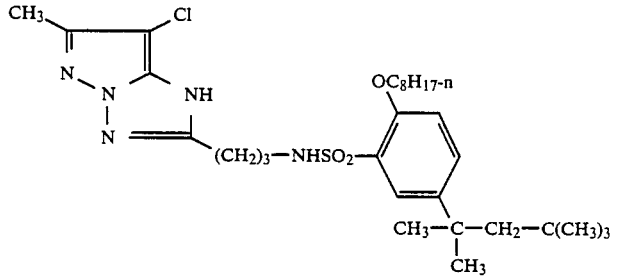
M-25
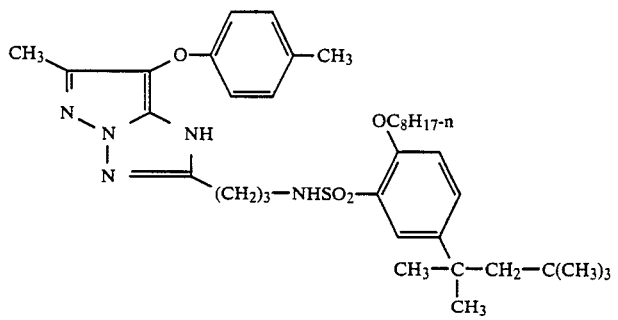
M-26
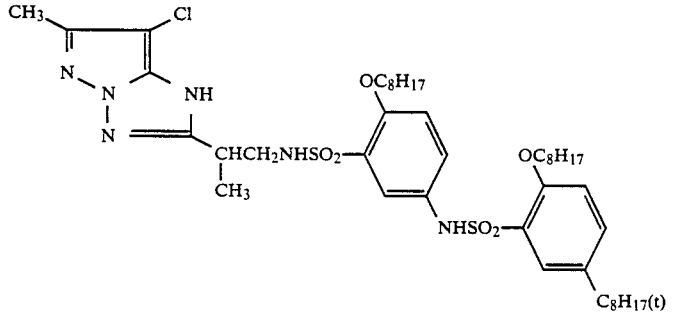
M-27
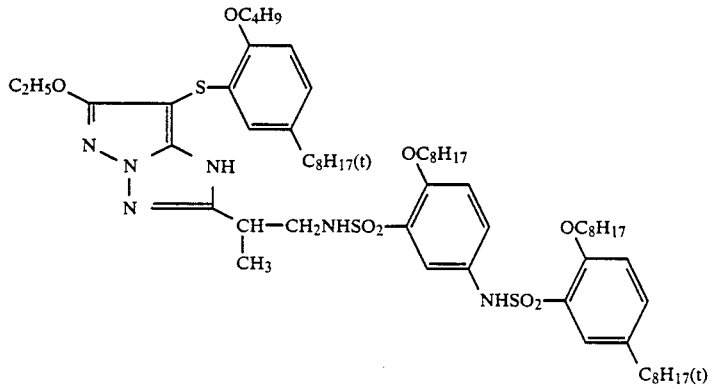

-continued
M-28
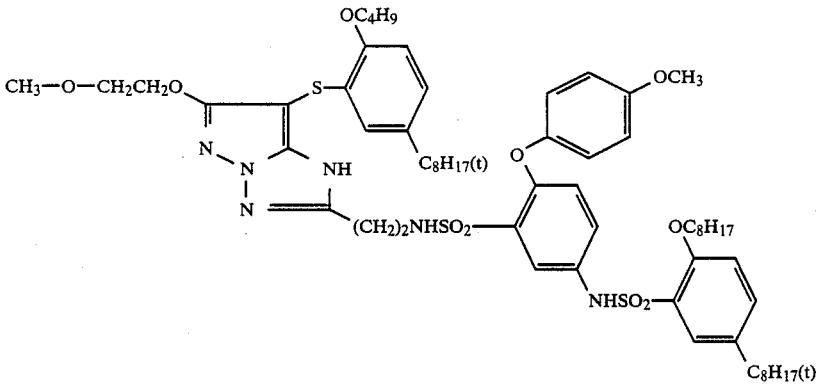
M-29
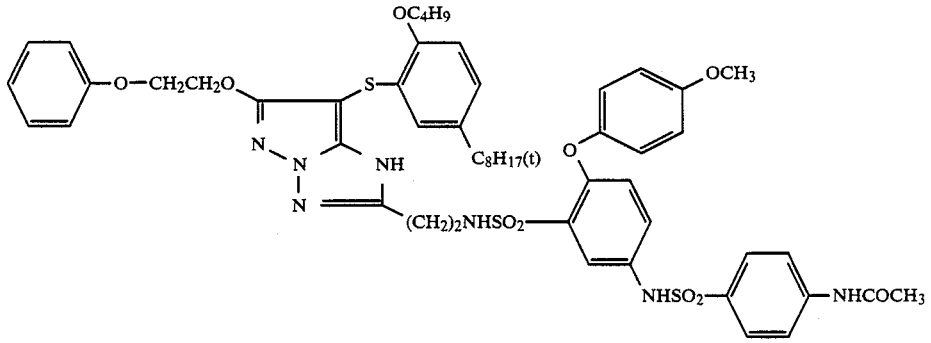
M-30
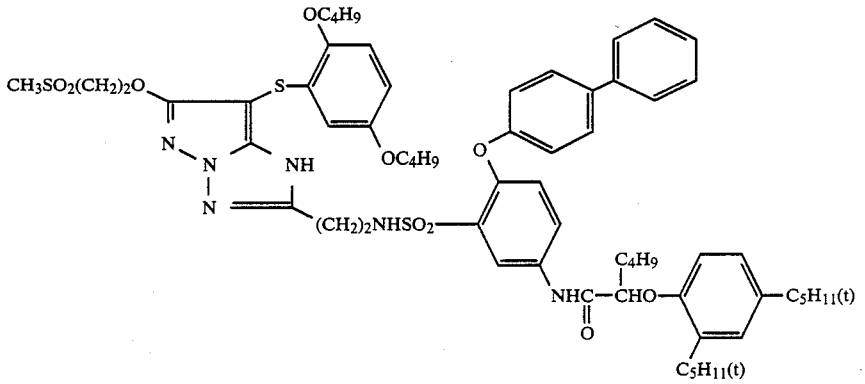
M-31
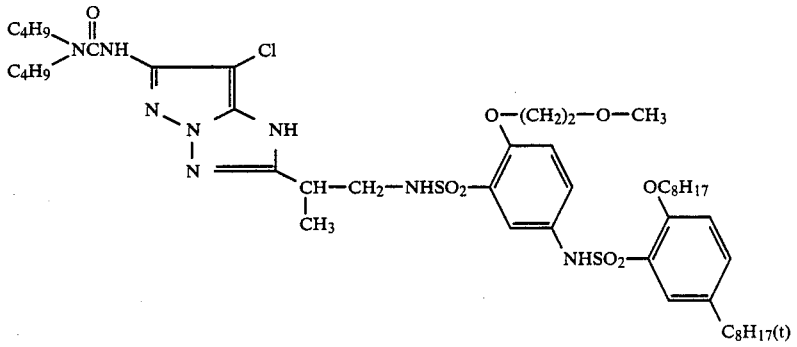

-continued
M-32
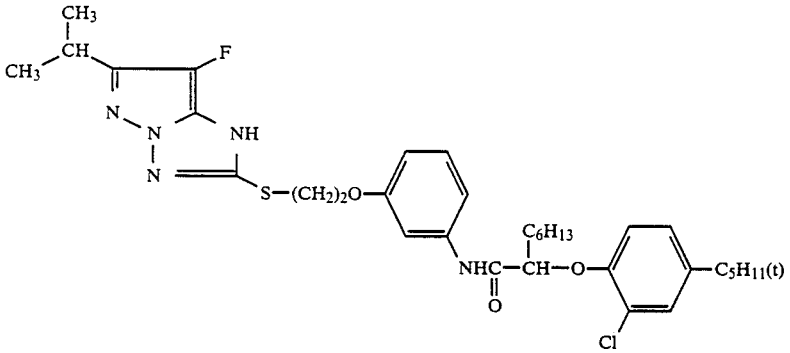
M-33
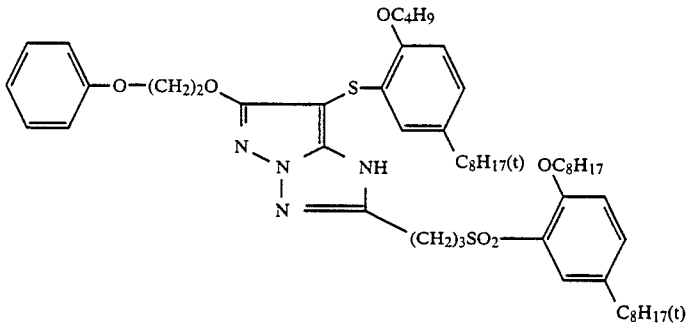
M-34
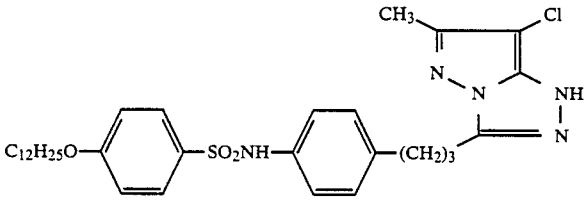
M-35
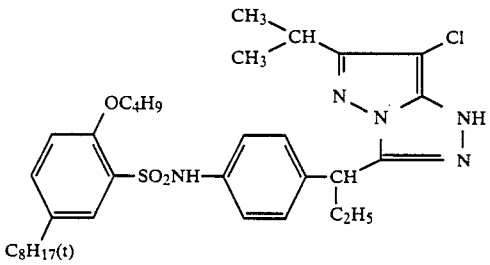
M-36
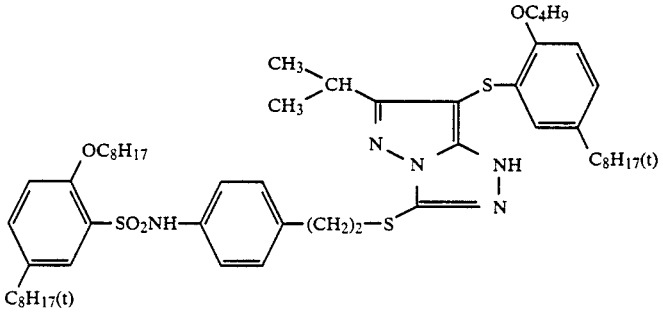

-continued
M-37
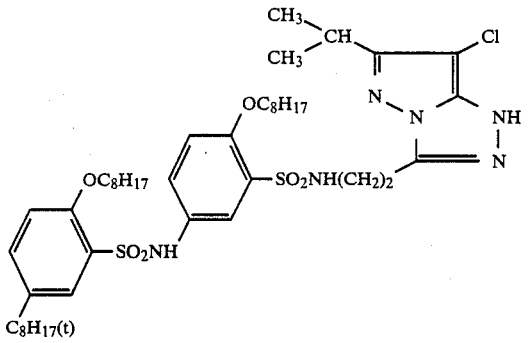
M-38
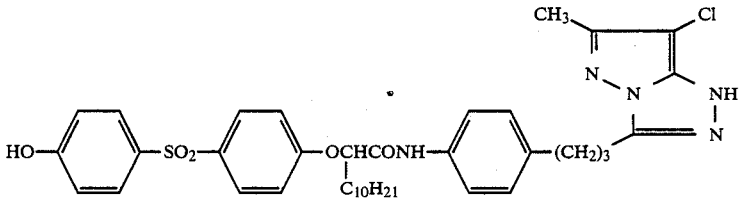
M-39
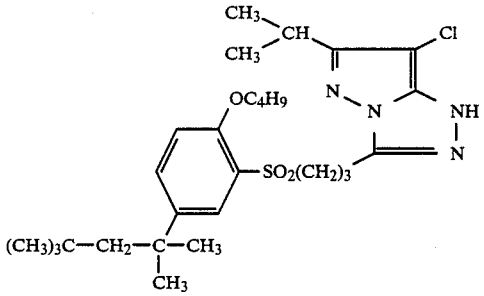
M-40
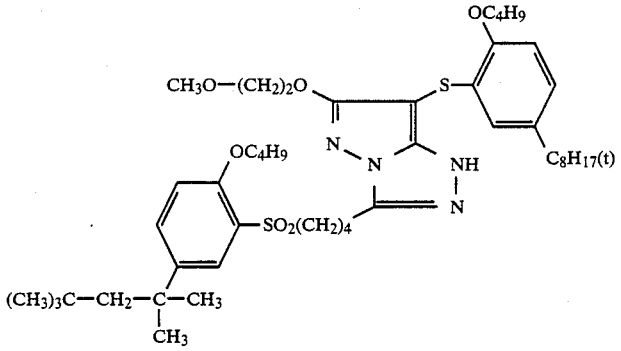
M-41
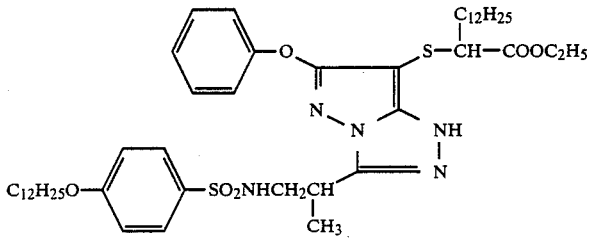

-continued
M-42
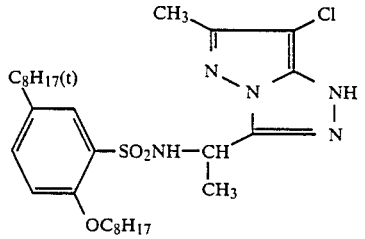
M-43
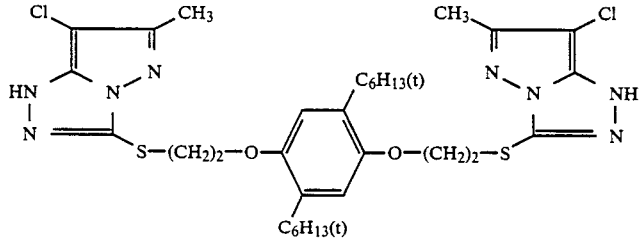
M-45
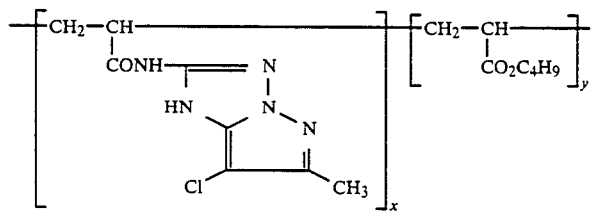
x:y 50:50 (weight ratio)
M-46
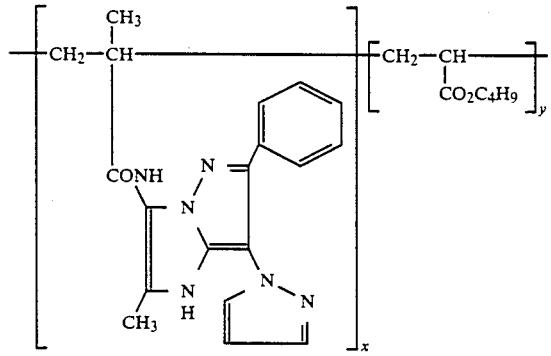
x:y = 55:45 (weight ratio)
The magenta couplers of the formula (I) are detailed in J.P. KOKAI No. 62-30250 (pp. 2 to 6) and the compounds listed therein (pp. 7 to 15) may be used in the invention.
The magenta couplers represented by the formula (II) will now be explained in detail.
(II)
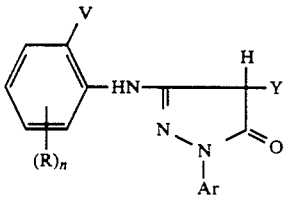

wherein Ar is a phenyl group which may be substituted; Y represents a group which is eliminated when the coupler causes coupling reaction with an oxidized form of an aromatic primary amine developing agent to form a dye; V is a halogen atom, an alkoxy group or an alkyl group; R represents a group which may be substituted for a hydrogen atom on a benzene ring; and n is an integer of 1 or 2; provided that if n is 2, R may be the same or different.

Each substituent Ar, Y, V or R in the formula (II) will specifically be explained below.

Ar: This is a phenyl group, in particular a substituted phenyl group. Examples of such substituents for phenyl group are a halogen atom, an alkyl group, an alkoxy group, an aryloxy group, an alkoxycarbonyl group, a cyano group, a carbamoyl group, a sulfamoyl group, a sulfonyl group, a sulfonamido group and an acylamino group. Ar may be substituted with 2 or more such substituents. Particularly preferred substituents are halogen atoms and most preferred is chlorine atom.

Y: This is a group which is eliminated when the coupler causes coupling reaction with the oxidized form of an aromatic primary amine developing agent to form a dye. Specific examples thereof are a halogen atom, an alkoxy group, an aryloxy group, an acyloxy group, an arylthio group, an alkylthio group, a group represented by the formula (a):

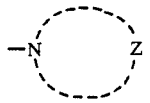

(a)

(wherein Z denotes an atomic group required to form a 5- or 6-membered ring together with the nitrogen atom and an atom selected from the group consisting of carbon, oxygen, nitrogen and sulfur atoms). Examples of groups (a) include pyrazolyl, imidazolyl, triazolyl and tetrazolyl groups. Particularly preferred Y is a group of S elimination type.

V: This is a halogen atom, an alkoxy group or an alkyl group. Particularly preferred is a halogen atom, inter alia, chlorine atom is preferred.

R: This is a group capable of being substituted for hydrogen atom on the benzene ring and n is an integer of 1 or 2. When n is 2, these R groups may be the same or different. Examples of substituents R are a halogen atom, R'—, R'O—, R'—CO—NR''—, R'$SO_2$—NR''—, R''—OCO—NR''—, R'—COO—, R'—NR''—CO—, R'—NR''—$SO_2$—, R'—O—CO—, R'—NR''—CO—NR'''—, and a group represented by the formula (b):

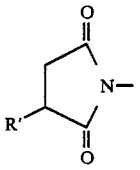

(b)

in these formulas, R', R'', R''' may be the same or different and each represents a hydrogen atom, or an alkyl, alkenyl r aryl group optionally having substituents. Particularly preferred examples are R'—CO—NH—, R'—$SO_2$—NH—and the group represented by the formula (b).

Specific examples of magneta couplers (II) are as follows, however, the present invention is not restricted to these specific examples at all.

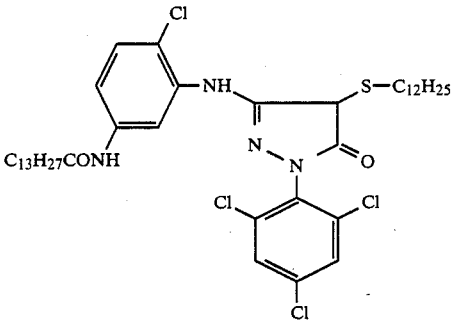

m-1

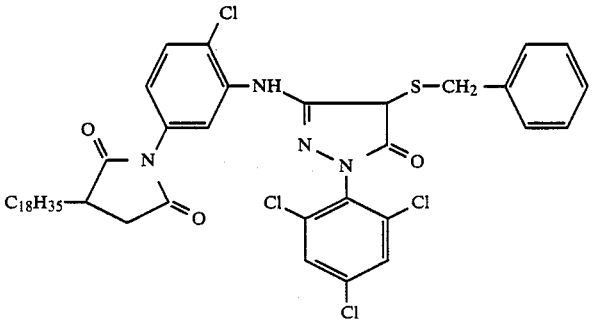

m-2

-continued
m-3
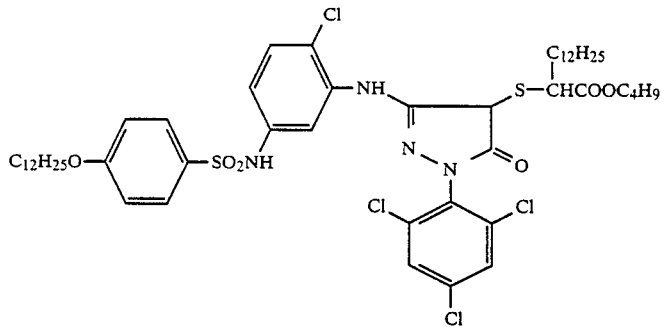
m-4
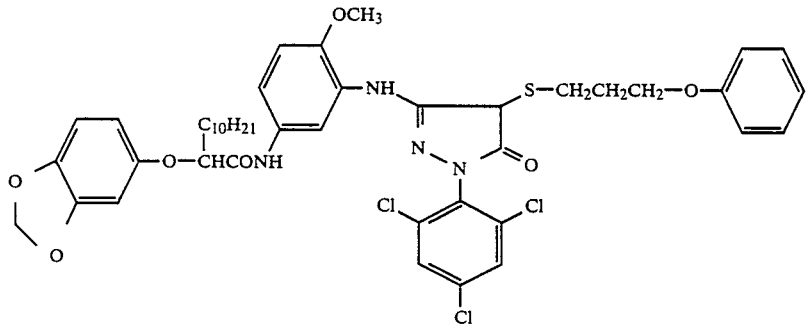
m-5
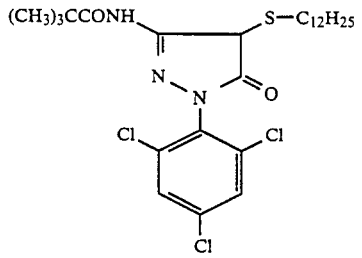
m-6
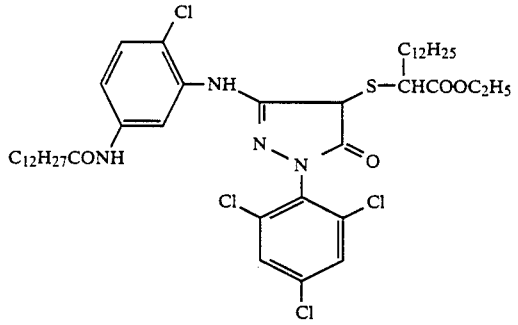
m-7
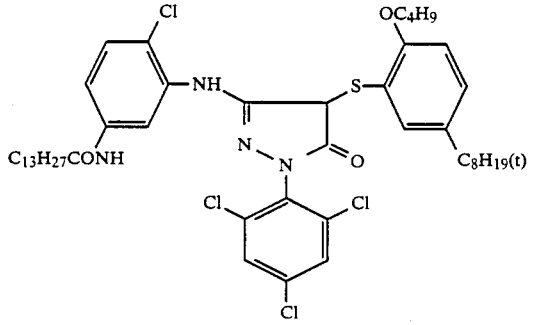

-continued
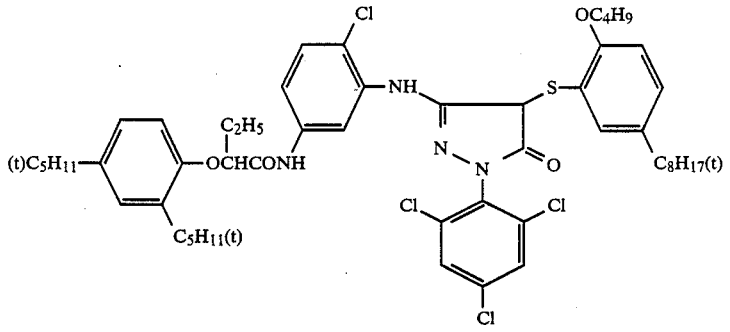
m-8
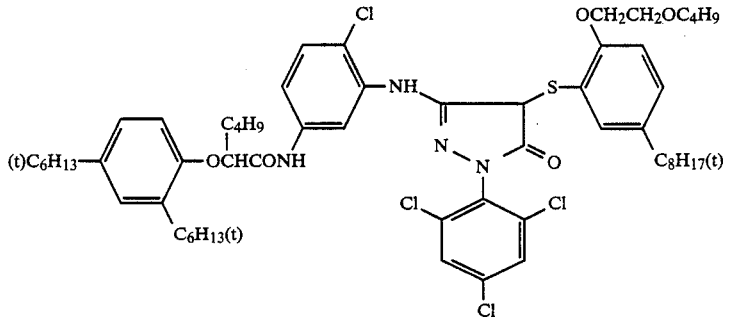
m-9
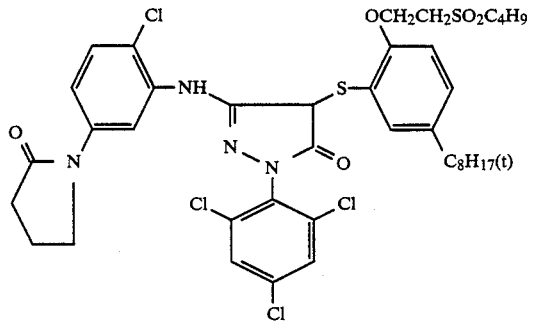
m-10
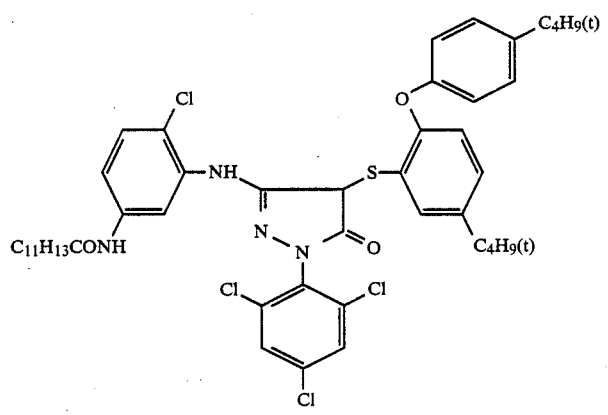
m-11

-continued
m-12
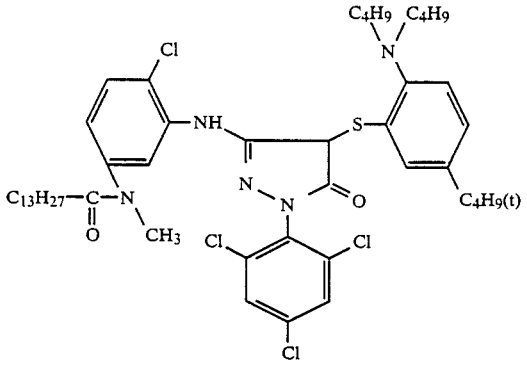
m-13
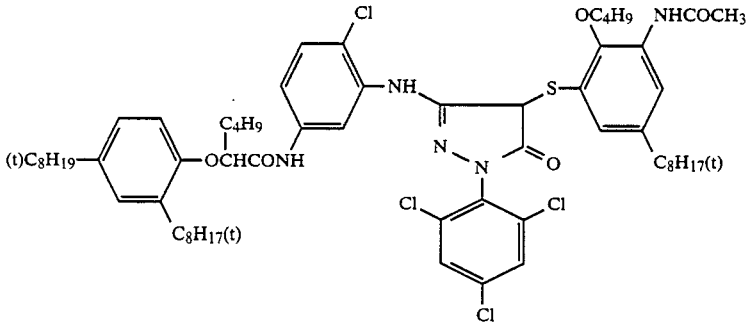
m-14
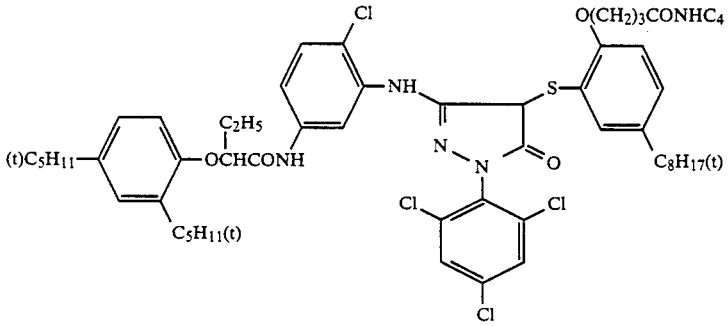
m-15
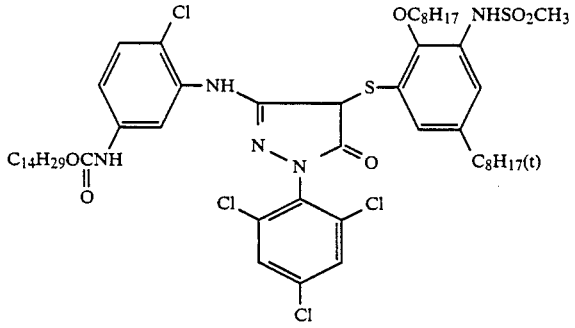
m-16
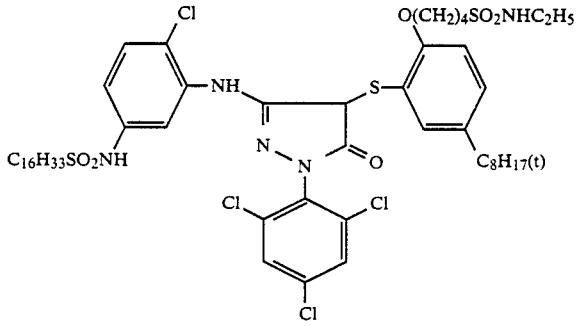

-continued
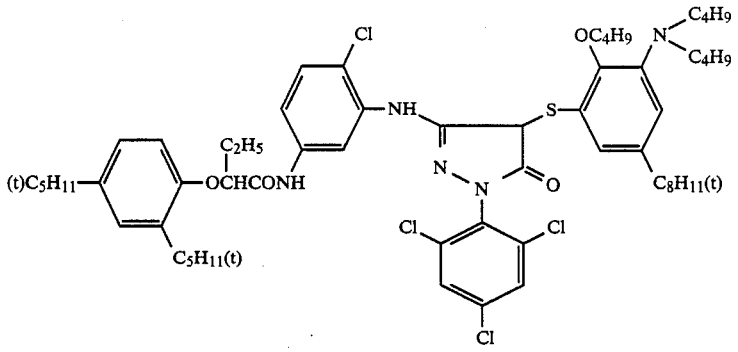
m-17
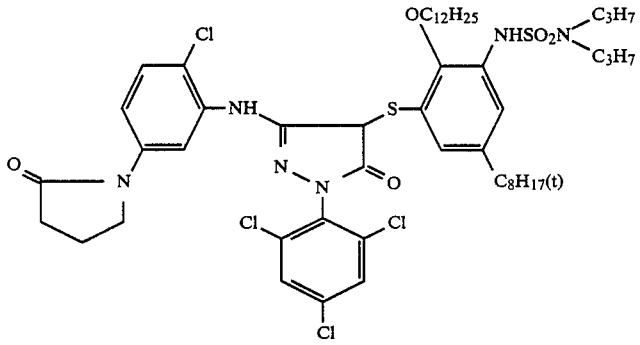
m-18
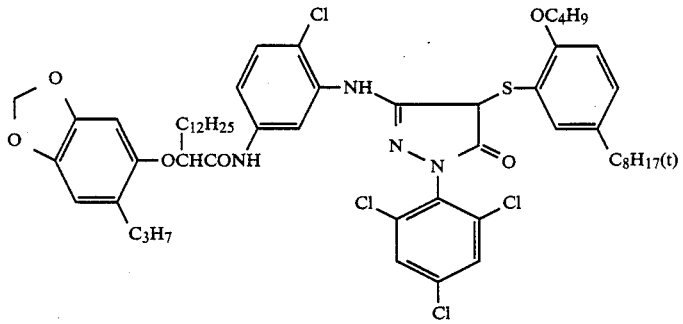
m-19
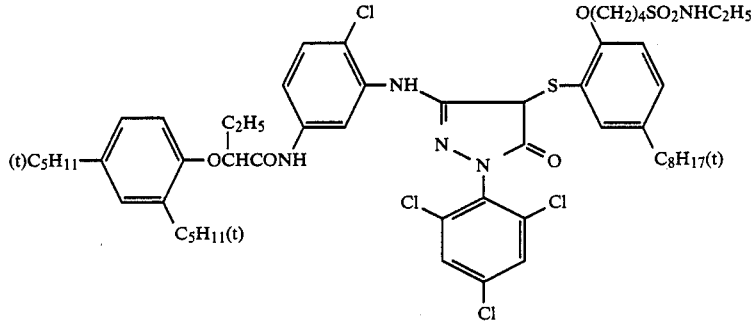
m-20

-continued
m-21
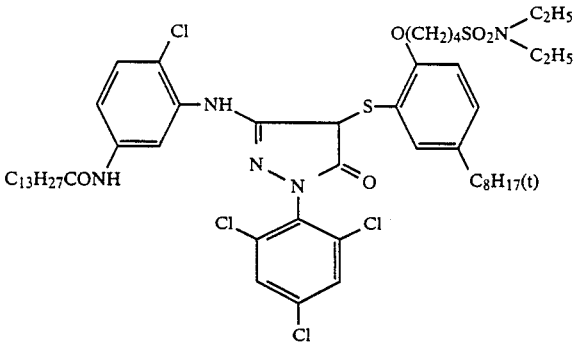
m-22
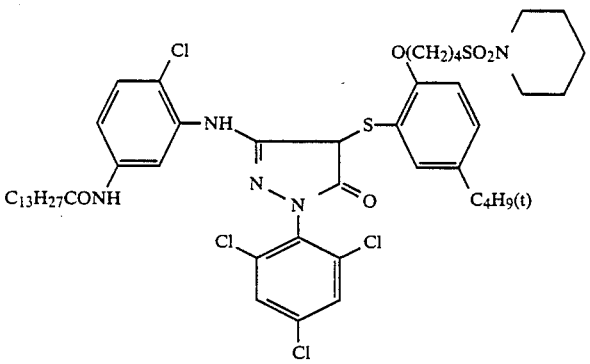
m-23
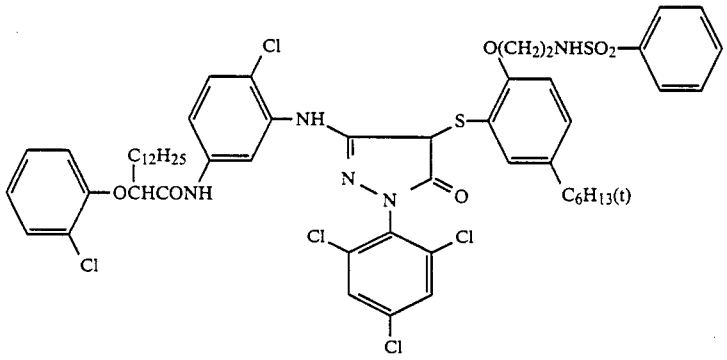
m-24
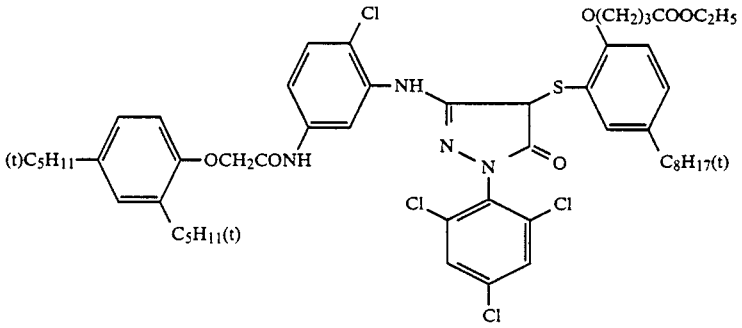

-continued
m-25
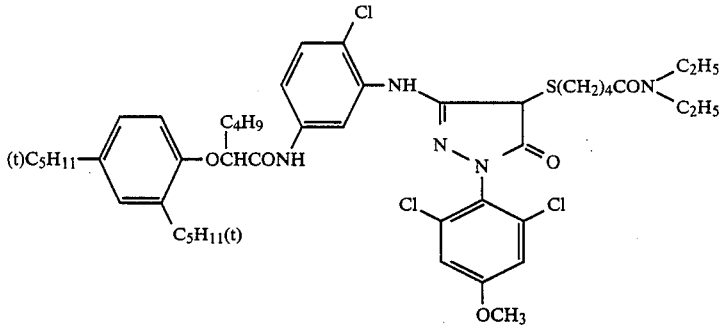
m-26
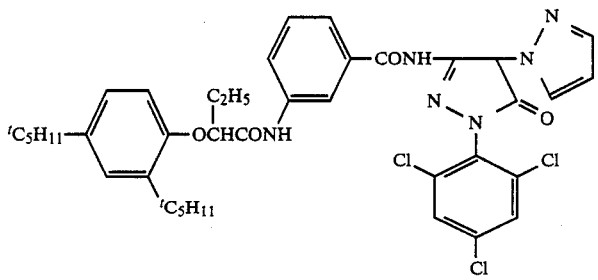
m-27
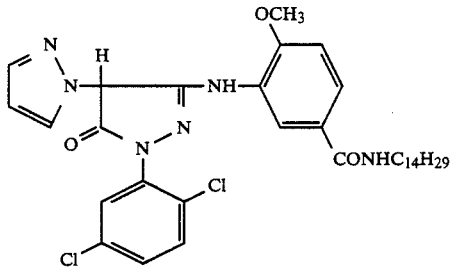
m-28
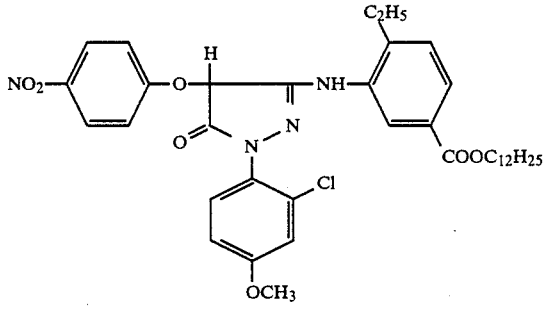
m-29
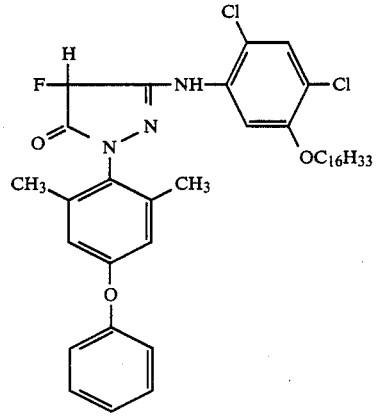

-continued m-30

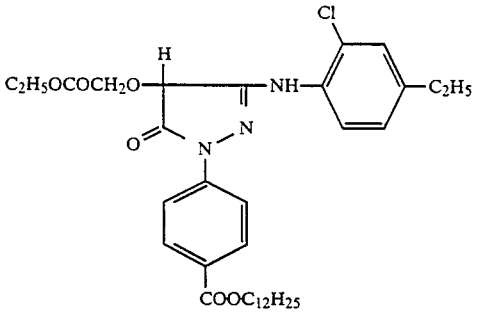

m-31

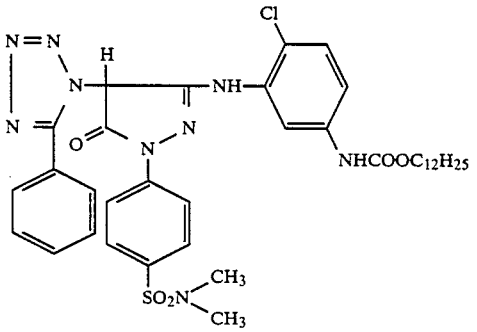

m-32

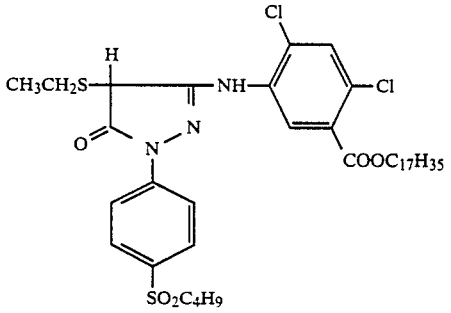

Magenta couplers (II) used herein are detailed in J.P. KOKAI Nos. 60-262161 (pp. 3 to 7) and 60-238832 (pp. 6 to 7) and compounds disclosed in J.P. KOKAI Nos. 60-262161 (pp. 7 to 11) and 60-238832 (pp. 7 to 9) may be used in the invention.

The magenta couplers used in the invention may be prepared in accordance with the methods disclosed, for instance, in J.P. KOKOKU No. 53-34044, J.P. KOKAI No. 55-62454 and U.S. Pat. No. 3,701,783 and the like.

Cyan couplers usable in the present invention include naphtholic or phenolic couplers of oil protect type. Typical examples of naphthol type couplers are those disclosed in U.S. Pat. No. 2,474,293. Typical preferred 2-equivalent type naphtholic couplers of oxygen atom elimination type are disclosed in U.S. Pat. Nos. 4,052,212; 4,146,396; 4,228,233; and 4,296,200. Exemplary phenol type couplers are those disclosed in U.S. Pat. Nos. 2,369,929; 2,801,171; 2,772,162 and 2,895,826.

Cyan couplers resistant to humidity and heat are preferably used in the invention. Examples of such couplers are phenol type cyan couplers with an alkyl group having 2 or more carbon atoms at a metha-position of a phenolic nucleus as described in U.S. Pat. No. 3,772,002; 2,5-diacylamino-substituted phenol type couplers as described in U.S. Pat. Nos. 2,772,162; 3,758,308; 4,126,396; 4,334,011; and 4,327,173; DEOS No. 3,329,729; and J.P. KOKAI No. 59-166956; and phenol type couplers having a phenylureido group at the 2-position and an acylamino group at 5-position of the phenol nucleus as described in U.S. Pat. Nos. 3,446,622; 4,333,999; 4,451,559; and 4,427,767.

Graininess may be improved by using together a coupler which can form a dye having a moderate diffusibility together with the abovementioned coupler. As such dye-forming couplers, some magenta couplers are specifically described in U.S. Pat. No. 4,366,237 and U.K. Pat. No. 2,125,570 and some yellow, magenta and cyan couplers are specifically described in European Pat. No. 96,570 and DEOS No. 3,234,533.

Dye-forming couplers and the aforementioned special couplers may be a dimer or a higher polymer. Typical examples of such polymerized dye-forming couplers are described in U.S. Pat. Nos. 3,451,820 and 4,080,211. Examples of such polymerized magenta couplers are described in U.K. Pat. No. 2,102,173 and U.S. Pat. No. 4,367,282.

In the present invention, at least two such couplers may be added to a single layer or one coupler may be added to two or more different layers to impart desired properties to the light-sensitive materials.

The couplers used in the invention can be introduced, into the light-sensitive materials, by a variety of known methods for dispersion. Examples of high boiling point organic solvents used in the oil-in-water dispersion method are disclosed in U.S. Pat. No. 2,322,027. Specific examples of processes, effects and latexes for impregnation for latex dispersion method are, for instance, disclosed in U.S. Pat. No. 4,199,363 and OLS Nos. 2,541,274 and 2,541,230.

The standard using amount of the color couplers is 0.001 to 1 mole per mole of light-sensitive silver halide and preferably 0.01 to 0.5 moles for yellow couplers; 0.003 to 0.3 moles for magenta couplers and 0.002 to 0.3 moles for cyan couplers.

The photographic light-sensitive materials used in the invention are applied onto a substrate commonly used such a flexible substrate as a plastic film (e.g., cellulose nitrate, cellulose acetate and polyethylene terephthalate) and paper or such a rigid substrate as a glass plate. Substrates and coating methods are detailed in Research Disclosure, Vol. 176, Item 17643 XV (p. 27) and XVII (p. 28) (December, 1978).

In the invention, reflecting substrates are preferably used. The "reflecting substrate" herein means a substrate having improved reflectivity and makes the dye images formed on silver halide emulsion layers clear. Examples of such substrates include those covered with a hydrophobic resin film including a reflective material dispersed therein, such as titanium oxide, zinc oxide, calcium carbonate and calcium sulfate and those composed of such a hydrophobic resin including a dispersed reflective material.

The processes for processing light-sensitive materials, in the invention will now be explained below in more detail.

In the processing of the present invention, color developing, bleach-fixing, water washing and/or stabilization processes are required.

The color developer used in the invention contains a known aromatic primary amine color developing agent. Preferred examples thereof are p-phenylenediamine derivatives of which typical examples are as follows, however, the present invention is not restricted to these specific examples:

D-1: N,N-Diethyl-p-phenylenediamine;
D-2: 2-Amino-5-diethylaminotoluene;
D-3: 2-Amino-5-(N-ethyl-N-laurylamino)-toluene;
D-4: 4-(N-Ethyl-N-(beta-hydroxyethyl)-amino)-aniline;
D-5:2-Methyl-4-(N-ethyl-N-(beta-hydroxyethyl)-amino)-aniline;
D-6: 4-Amino-3-methyl-N-ethyl-N-(beta-(methanesulfonamido) ethyl)-aniline;
D-7:N-(2-Amino-5-diethylaminophenylethyl)-methanesulfonamide;
D-8: N,N-Dimethyl-p-phenylenediamine;
D-9: 4-Amino-3-methyl-N-ethyl-N-methoxyethylaniline;
D-10: 4-Amino-3-methyl-N-ethyl-N-beta-ethoxyethylaniline;
D-11: 4-Amino-3-methyl-N-ethyl-N-beta-butoxyethylaniline.

Among the foregoing p-phenylenediamine derivatives, particularly preferred is 4-amino-3-methyl-N-ethyl-N-(beta-(methanesulfonamido)-ethyl)-aniline (exemplary compound D-6).

These p-phenylenediamine derivatives may be a salt such as sulfate, hydrochloride, sulfite, and p-toluenesulfonate. The using amount of the aromatic primary amine developing agent is preferably about 0.1 to about 20 g, more preferably about 0.5 to about 10 g per liter of developer.

The color developer may optionally contain a preservative such as sulfites, for instance, sodium sulfite, potassium sulfite, sodium bisulfite, potassium bisulfite, sodium metasulfite and potassium metasulfite; or carbonyl-sulfite adducts.

It is also preferred to add, to the developer, compounds for directly preserving the foregoing color developing agent such as various hydroxylamines; hydroxamic acids as disclosed in Japanese Patent Application Ser. (hereunder referred to as J.P.A.) No. 61-186559 (J.P. KOKAI No. 63-43138); hydrazines and hydrazides as disclosed in J.P.A. No. 61-170756 (EP-A-254280, U.S. Ser. No. 76505); phenols as disclosed in J.P.A. Nos. 61-188742 (J.P. KOKAI No. 63-44657) and 61-203253; alpha-hydroxy-ketones and alpha-aminoketones as disclosed in J.P.A. No. 61-188741 (J.P. KOKAI 63-44656); and/or various sugars as disclosed in J.P.A. No. 61-180616 (J.P. KOKAI No. 63-36244). In addition, it is preferable to simultaneously add, thereto, monoamines as disclosed in J.P.A. Nos. 61-147823 (J.P. KOKAI NO. 63-4235), 61-166674 (J.P. KOKAI No. 63-24254), 61-165621 (J.P. KOKAI No. 63-21647), 61-164515 (U.S. Ser. No. 72479), 61-170789 (J.P. KOKAI No. 63-27841) and 61-168159 (J.P. KOKAI No. 63-25654); diamines as disclosed in J.P.A. Nos. 61-173595 (J.P. KOKAI No. 63-30845), 61-164515 (U.S. Ser. No. 72479) and 61-186560 (J.P. KOKAI No. 63-43139); polyamines as disclosed in J.P.A. Nos. 61-165621 (J.P. KOKAI No. 63-21647), 61-169789 (J.P. KOKAI No. 63-26655) and 61-188619 (J.P. KOKAI No. 63-44655); nitroxy radicals as disclosed in J.P.A. No. 61-197760 (J.P. KOKAI No. 63-53551); alcohols as disclosed in J.P.A. Nos. 61-186561 (J.P. KOKAI No. 63-43140) and 61-197419 (J.P. KOKAI No. 63-53349); oximes as disclosed in J.P.A. No. 61-198987 (J.P. KOKAI No. 53-56654); and tertiary amines as disclosed in J.P.A. No. 61-265149 (U.S. Ser. No. 117727).

The color developers may optionally contain other preservatives such as various metals as disclosed in J.P. KOKAI Nos. 57-44148 and 57-53749; salicylic acids as disclosed in J.P. KOKAI No. 59-180588; alkanol amines as disclosed in J.P. KOKAI No. 54-3532; polyethyleneimines as disclosed in J.P. KOKAI No. 56-94349; aromatic polyhydroxyl compounds as disclosed in U.S. Pat. No. 3,746,544. The addition of compounds such as aromatic polyhydroxy compounds, alkanol amines and compounds as disclosed in J.P.A. No. 61-264159 is particularly preferred.

The pH value of the color developers used in the invention preferably ranges from 9 to 12, more preferably 9 to 11. These color developers may further contain known other components for developer.

In order to maintain the foregoing pH range, various pH buffering agents are preferably used. Examples of such buffering agents are carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. Particularly preferred buffering agents are carbonates, phosphates, tetraborates and hydroxybenzoates because they have good solubility, excellent buffering ability at high pH range of not less than 9.0, exert no influence on photographic properties such as fogging and are cheap.

Specific examples thereof are sodium carbonate, potassium carbonate, sodium bicarbonate, potassium bicarbonate, trisodium phosphate, tripotassium phosphate, disodium hydrogen phosphate, dipotassium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfo-salicylate) and potassium 5-sulfo-2-hydroxybenzoate (potassium 5-sulfo-salicylate). However, the invention is not restricted to these specific compounds.

The amount of these buffering agents added to the color developers is preferably not less than 0.1 mole/1, more preferably 0.1 to 0.4 mole/1.

In addition to the foregoing components, the color developers may contain a variety of chelating agents as a suspension stabilizer for calcium and/or magnesium or for the purpose of enhancing the stability of the color developers.

Preferred examples of such chelating agents are organic compounds such as aminopolycarboxylic acids as disclosed in J.P. KOKOKU Nos. 48-30496 and 44-30232; organic phosphonic acids as disclosed in J.P. KOKAI No. 56-97347, J.P. KOKOKU No. 56-39359 and German Patent No. 2,227,639; phosphonocarboxylic acids as disclosed in J.P. KOKAI Nos. 52-102726, 53-42730, 54-121127, 55-126241 and 55-659506; and compounds as disclosed in J.P. KOKAI Nos. 58-195845 and 58-203440 and J.P. KOKOKU No. 53-40900. Specific examples thereof are as follows:

Nitrilotriacetate, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1.2-diaminopropanetetraacetic acid, glycoletherdiaminetetraacetic acid, ethylenediamine-o-hydroxyphenylacetic acid, 2-phosphonobutane-1,2,4 tricarboxylic acid, 1-hydroxyethylidene-1,1-diphosphonic acid, N,N'-bis(2-hydroxybenzyl)-ethylenediamine-N,N'-diacetic acid, hydroxyethyliminodiacetic acid.

These chelating agents may be used alone or in combination.

The chelating agents are added to the color developers in an amount sufficient to sequester metal ions, which, for instance, ranging from 0.1 to, 10 g/1.

The color developers may optionally contain any development accelerator. However, the developer is preferably substantially free from benzyl alcohol from the viewpoint of emvironmental protection, easy preparation of developer and prevention of color-stains. The term "substantially free from" herein means that benzyl alcohol is not more than 2 ml per liter of developer and preferably zero.

It is also possible to optionally add other development accelerators such as thioether type compounds as disclosed in J.P. KOKOKU Nos. 37-16088, 37-5987, 38-7826, 44-12380 and 45-9019 and U.S. Pat. No. 3,813,247p-phenylenediamine type compounds as disclosed in J.P. KOKAI Nos. 52-49829 and 50-15554; quaternary ammonium salts as disclosed in J.P. KOKAI Nos. 50-137726, 56-156826 and 52-43429 and J.P. KOKOKU No. 44-30074; amine type compounds as disclosed in U.S. Pat. Nos. 2,494,903, 3,128,182, 4,230,796, 3,253,919, 2,482,546, 2,596,926 and 3,582,346 and J.P. KOKOKU No. 41-11431; polyalkylene oxides as disclosed in J.P. KOKOKU Nos. 37-16088, 42-25201, 41-11431 and 42-23883 and U.S. Pat. Nos. 3,128,183 and 3,532,501; 1-phenyl-3-pyrazolidones; and imidazoles.

The color developers used in the invention may, if necessary, contain any antifogants. As the antifoggants, there may be used such an alkali metal halide as sodium chloride, potassium bromide and potassium iodide; and organic antifoggants. Typical examples of the latter include nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine and adenine.

The color developers used in the invention preferably contain fluorescent whiteners. Preferred examples thereof are 4,4'-diamino-2,2'-disulfostilbene type compounds and the amount thereof to be used ranges from 0 to 5 g/1 and preferably from 0.1 to 4 g/1.

Moreover, the developers may optionally contain various kinds of surfactants such as alkylsulfonic acids, arylsulfonic acids, aliphatic: carboxylic acids and aromatic carboxylic acids.

During processing, the temperature of the color developer ranges from 20° to 50° C. and preferably 30 ° to 40° C., while the processing time is 20 seconds to 5 minutes and preferably 30 seconds to 2 minutes. The amount of the developer to be replenished is preferably as low as possible, however, it ranges from 20 to 600 ml, preferably 50 to 300 ml and more preferably 100 to 200 ml per 1 $m^2$ of the light-sensitive material to be processed.

The desilvering process of the present invention will be explained below. The desilvering process in the invention may be either of fixing process and bleach-fixing process; bleaching process and bleach-fixing process; or bleach-fixing process, however, preferred examples thereof is bleach-fixing process. The processing time in the invention is preferably not more than 2 minutes, more preferably 15 to 60 seconds.

Referring now to the bleach-fixing solutions, any bleaching agents may be used in the present invention, however, particularly preferred examples thereof are organic complex salts of iron(III), for instance, those with an aminopolycarboxylic acid such as ethylenediaminetetraacetic acid and diethylenetriaminepentaacetic acid; aminopolyphosphonic acid, phosphonocarboxylic acid and organophosphonic acid; an organic acid such as citric acid, tartaric acid and malic acid; persulfates, hydrogen peroxide.

Among these, the organic complex salts of iron(III) are particularly preferred from the viewpoint of rapid processing and prevention of emvironmental pollution. Examples of aminopolycarboxylic acids, aminopolyphosphonic acids, organophosphonic acids or salts thereof useful for forming organic complex salts of iron(III) are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid.

These compounds may be sodium, potassium, lithium or ammonium salts. Particularly, iron(III) complex salts with ethylenediaminetetraacetic acid, diethylenetriaminepentaacetic acid, cyclohexanediaminetetraacetic acid, 1,3-diaminopropanetetraacetic acid and methyliminodiacetic acid are preferred in view of their high bleaching ability.

These ferric ion complex salts may be used in the form of complex salts per se or may be prepared in the solution by reacting a ferric salt such as ferric sulfate, ferric chloride, ferric nitrate, ferric ammonium sulfate or ferric phosphate with a chelating agent such as aminopolycarboxylic acid, aminopolyphosphonic acid or phosphonocarboxylic acid. It is possible to use such a chelating agent in an amount greater than that required to form ferric ion complex salt. Preferred iron complexes are those with aminopolycarboxylic acids.

These bleaching agents are used in an amount of not more than 0.1 mole/1, preferably 0.03 to 0.1, more preferably 0.05 to 0.08 mole/1. This is because if the concentration thereof is higher than or lower than the foregoing value, the desilvering time becomes long. Bleaching baths and the preceding baths may optionally contain a variety of bleaching accelerators. Examples thereof are compounds having a mercapto group or a disulfide bond such as those disclosed in U.S. Pat. No.3,893,858, German Patent No. 1,290,812, J.P. KOKAI No. 53-95630 and Research Disclosure No. 17129 (July, 1978); thiourea compounds such as those disclosed in J.P. KOKOKU No. 45-8506, J.P. KOKAI Nos. 52-20832 and 53-32735 and U.S No. 3,706,561; or halides such as iodide or bromide ions.

The bleach-fixing solutions used in the invention may contain a re-halogenating agent such as bromides (e.g., potassium bromide, sodium bromide and ammonium bromide), chlorides (e.g., potassium chloride, sodium chloride and ammonium chloride) or iodides (e.g., ammonium iodide). The bleach-fixing solutions may optionally contain at least one compound having pH buffering ability selected from the group consisting of inorganic acids, organic acids and alkali metal or ammonium salts thereof such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; or an anticorrosive agent such as ammonium nitrate or guanidine.

Fixing agents used in the fixing solutions of the invention may be any known fixing agents such as thiosulfates (e.g., sodium thiosulfate and ammonium thiosulfate); thiocyanates [e.g., sodium thiocyanate and ammonium thiocyanate); thioether compounds (e.g., ethylene-bis(-thioglycolic acid) and 3,6-dithia-1,8-octanediol); and water-soluble silver halide dissolving agents (e.g., thioureas) and these fixing agents may be used alone or in combination. In addition, it is also possible to use such a specific bleach-fixing solution as those comprising a combination of a fixing agent and a large amount of a halide such as potassium iodide, as disclosed in J.P. KOKAI No. 55-155354. In the present invention, thiosulfates, in particular, ammonium thiosulfate are preferably used. The using amount of these fixing agents are preferably not more than 0,5 mole/1, preferably 0.15 to 0.5 mole/1, more preferably 0.2 to 0.45 mole/1. The use of the fixing agent in concentration of less than 0.2 mole/1 is undesirable because the fixing speed is lowered The pH value of the bleach-fixing solution preferably ranges from 3 to 10 and particularly preferred range thereof is 4 to 9.

The bleach-fixing solutions may further contain various fluorescent whiteners, antifoaming agents, surfactants, polyvinyl pyrrolidone and organic solvents such as methanol other than the foregoing components.

The bleach-fixing solutions in the present invention may contain, as preservatives, sulfite ion-releasing compounds such as sulfites (e.g., sodium sulfite, potassium sulfite and ammonium sulfite), bisulfites (e.g., ammonium bisulfite, sodium bisulfite and potassium bisulfite), metabisulfites (potassium metabisulfite, sodium metabisulfite and ammonium metabisulfite). These compounds are added to the solution in an amount preferably ranging from about 0.02 to 0.50 mole/1, more preferably 0.04 to 0.40 mole/1 expressed in the amount of sulfite ions.

Although, sulfites are commonly used as a preservative, it is also possible to use other preservatives such as ascorbic acid, carbonyl-bisulfite adducts or carbonyl compounds.

The bleach-fixing solutions may further contain other additives such as buffering agents, fluorescent blighteners, chelating agents, antifoaming agents and mold controlling agents.

The silver halide color photographic light-sensitive materials are in general washed with water and/or stabilized in a stabilizing solution subsequent to the desilvering processing or bleach-fixing treatment.

The amount of water in water washing process may widely be established depending on a variety of conditions such as properties of the light-sensitive materials which vary depending on, for instance, kinds of materials used, such as couplers or applications thereof, temperature of the washing water, number of water washing tanks (number of steps) or replenishing methods such as countercurrent flow system or direct flow system. Among these, the relation between the number of washing tanks and the amount of water in the multistage countercurrent system can be determined according to the method described in Journal of the Society of Motion Picture and Television Engineers, Vol. 64, p-248–253 (May, 1955). Generally, the step number in the multistage countercurrent system is preferably 2 to 6 and particularly preferred thereof is 2 to 4.

The multistage countercurrent system makes it possible to substantially reduce the amount of washing water to, for instance, not more than 0.5 to 1 liter per 1 $m^2$ of the light-sensitive material processed and outstanding effects of the invention would be attained. However, bacteria proliferate in the processing baths since the residence time of water in the tanks increases.

This leads to the formation of floating substances which adhere to the processed light-sensitive materials. In the processing of color light-sensitive materials, the method for reducing the amount of calcium and magnesium described in J.P.A. No. 61-131623 may be conveniently employed to solve the foregoing problem. The problem of proliferation of bacteria may also be solved by using antibacterial agents such isothiazolone compounds or thiabendazoles as those disclosed in J.P. KOKAI No. 57-8542; such chlorine type antibacterial agents as sodium chloroisocyanurate disclosed in J.P. KOKAI No. 61-120145; such benzotriazoles as those disclosed in J.P.A. No. 60-105487; copper ions; or such other antibacterial agents as those disclosed in "BOKIN BOBAIZAI NO KAGAKU (Chemistry of Antibacterial and Antifungus Agents)", Hiroshi HORIGUCHI; BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus Agents", edited by Japan Bacteria and Fungi Controlling Society.

Moreover, the washing water may contain surfactants as a wetting agent and chelating agents such as EDTA as a softener for hard water.

The stabilization process may be carried out directly without carrying out the water washing process or subsequent to the water washing process. The stabilization solutions contain compounds capable of stabilizing images, such aldehyde compounds as formalin; buffering agents for adjusting film pH suitable for stabilizing dye images; and ammonium compounds. In order to prevent the proliferation of bacteria and impart the mold controlling property to the processed light-sensitive materials, the aforementioned antibacterial agents and the mold controlling agents may be used.

These solutions may contain surfactants, fluorescent whiteners, and film hardening agents. When the stabilization process is directly carried out without carrying out the water washing in the method of this invention, it is possible to use any known methods such as those disclosed in J.P. KOKAI Nos. 57-8543, 58-14834 and 60-220345.

Besides, in a preferred embodiment, chelating agents such as 1-hydroxyethylidene-1,1-diphosphonic acid and ethylenediaminetetramethylenephosphonic acid and magnesium or bismuth compounds may be used.

In the present invention, so-called rinsing solution may likewise be used in place of the washing water or stabilization solution employed after the desilvering process.

pH of the washing water or the stabilization solution ranges from 4 to 10, preferably from 5 to 8. The temperature thereof may vary depending on the factors such as applications and properties of the light-sensitive materials to be processed, however, it is generally at from 15 to 45° C., preferably from 20° to 40° C. The processing time is not critical, however, notable effects may be expected if it is as short as possible. It is preferably 15 seconds to 2 minutes and more preferably 30 seconds to 1.5 minutes. The amount of these solutions replenished is preferably small from the viewpoint of running cost, reduction in the amount of waste and handling properties and more excellent effects can thereby be attained.

Specifically, the preferred amount thereof to be replenished is 3 to 50 times, more preferably 5 to 40 times the volume of liquid carried over from the bath preceding preceding the water washing bath and/or the stabilization bath. Alternatively, it is not more than 1 liter, preferably not more than 500 ml per 1 $m^2$ of the processed light-sensitive material. The replenishment thereof may be carried out continuously or periodically. When the continuous replenishment is carried out by using the bleach-fixing solution of the present invention, the image storability of the treated light-sentive material is extremely improved and the stability of the washing bath and/or the stabilization bath is also remarkably improved.

The used solutions for the water washing and/or the stabilization processes may be recycled to the preceding process. One such example is to make the overflow of washing water reduced by applying multistage countercurrent system flow into the preceding bath or the bleach-fixing bath while replenishing a concentrate to the latter to reduce the amount of waste.

The overall time required to carry out desilvering, water washing and/or stabilization processes in the invention is preferably not more than 4 minutes, more preferably 30 seconds to 3 minutes. The term "overall time" herein means the period from the moment at which the silver halide photographic light-sensitive material brings into contact with the first bath for desilvering process to the moment at which it leaves the last bath for water washing or stabilization, and which includes the period during which the material is not contacted with the bath for transferring the material.

The method of the present invention may be applied to any processings including the use of color developers. It can be applied to the processing of, for instance, color paper, color reversal paper, color direct positive light-sensitive materials, color positive films, color negative films and color reversal films and in particular color paper and color reversal paper.

EXAMPLE

The present invention will now be explained in more detail with reference to the following Examples.

Example 1

Multilayered photographic paper having the following layer structures were produced by applying coating solutions onto a paper substrate of which both sides had been laminated with polyethylene films, while changing the coated amount of silver. The coating solutions were prepared as follows:

(Preparation of the Coating Solution for 1st Layer)

To yellow couplers ExY-1 and ExY-2 (10.2 g and 9.1 g respectively) and 4.4 g of a dye image stabilizer (Cpd-1) there were added 27.2 ml of ethyl acetate and 7.7 ml of a high boiling point solvent (Solv-1) to dissolve them and the solution was dispersed in 185 ml of 10% gelatin aqueous solution containing 8 ml of 10% sodium dodecybenzene sulfonate to form an emulsion. The emulsion was mixed with and dispersed in emulsions EM 1 and EM 2 and the concentration of gelatin thereof was adjusted so as to consistent with the following composition to obtain the coating solution for 1st layer. The coating solutions for 2nd to 7th layers were also prepared in the same manner. To each layer, sodium salt of 1-oxy-3,5-dichloro-s-triazine was added as a gelatin hardening agent. Moreover, Cpd-2 was used as a thickening agent.

(Layer Structure)

The composition of each layer is given below. Numerical values are coated amounts expressed in $g/m^2$.

Substrate:

Paper laminated with polyethylene films (the polyethylene film on the side of the 1st layer includes white pigment ($TiO_2$) and a blueing dye).

| | |
|---|---|
| 1st Layer: Blue-sensitive Emulsion Layer | |
| Monodisperse silver chlorobromide emulsion spectrally sensitized with sensitizing dye ExS-1 (EM 1) | (see Table I) |
| Monodisperse silver chlorobromide emulsion spectrally sensitized with sensitizing dye ExS-1 (EM 2) | (see Table I) |
| Gelatin | 1.86 |
| Yellow coupler ExY-1 | 0.44 |
| Yellow coupler ExY-2 | 0.39 |
| Dye image stabilizer Cpd-1 | 0.19 |
| Solvent Solv-1 | 0.35 |
| 2nd Layer: Color Mixing Inhibiting Layer | |
| Gelatin | 0.99 |
| Color mixing inhibitor Cpd-3 | 0.08 |
| 3rd Layer: Green-sensitive Emulsion Layer | |
| Monodisperse silver chlorobromide emulsion spectrally sensitized with sensitizing dyes | (see Table I) |

-continued

| | |
|---|---|
| ExS-2,3 (EM 3) | |
| Monodisperse silver chlorobromide emulsion spectrally sensitized with sensitizing dyes | (see Table I) |
| ExS-2,3 (EM 4) | |
| Gelatin | 1.80 |
| Magenta coupler ExM-1 | 0.39 |
| Dye image stabilizer Cpd-4 | 0.20 |
| Dye image stabilizer Cpd-5 | 0.02 |
| Dye image stabilizer Cpd-6 | 0.03 |
| Solvent Solv-2 | 0.12 |
| Solvent Solv-3 | 0.25 |
| 4th Layer: Ultraviolet Absorbing Layer | |
| Gelatin | 1.60 |
| Ultraviolet absorber (Cpd-7/Cpd-8/Cpd-9 = 3/2/6: weight ratio) | 0.70 |
| Color mixing inhibitor Cpd-10 | 0.05 |
| Solvent Solv-4 | 0.27 |
| 5th Layer: Red-sensitive Emulsion Layer | |
| Monodisperse silver chlorobromide emulsion spectrally sensitized with sensitizing dyes | (see Table I) |
| ExS-4,5 (EM 5) | |
| Monodisperse silver chlorobromide emulsion spectrally sensitized with sensitizing dyes | (see Table I) |
| ExS-4,5 (EM 6) | |
| Gelatin | 0.92 |
| Cyan coupler ExC-1 | 0.32 |
| Dye image stabilizer (Cpd-8/Cpd-9/Cpd-12 = 3/4/2: weight ratio) | 0.17 |
| Polymer for dispersion Cpd-11 | 0.28 |
| Solvent Solv-2 | 0.20 |
| 6th Layer: Ultraviolet Absorbing Layer | |
| Gelatin | 0.54 |
| Ultraviolet absorber (Cpd-7/Cpd-9/Cpd-12 = 1/5/3: weight ratio) | 0.21 |
| Solvent Solv-2 | 0.08 |
| 7th Layer: Protective Layer | |
| Gelatin | 1.33 |
| Acrylic modified copolymer of polyvinyl alcohol (degree of modification = 17%) | 0.17 |
| Liquid parahhin | 0.03 |

In this case, Cpd-13 and Cpd-14 were used as irradiation inhibiting dyes.

In addition to the foregoing comonents, each layer comprised Alkanol XC (available from Dupont Co., Ltd.), sodium alkylbenzenesulphonate, succinate and Magefacx F-120 (available from DAINIPPON INK AND CHEMICALS, INC.) as an emulsifying and dispersing agent and a coating aid.

The details of the emulsions used are as follows:

| Emulsion | Grain Size (micron) | Br Content (mole %) | Coefficient of Variation |
|---|---|---|---|
| EM-1 | 1.0 | 80 | 0.08 |
| EM-2 | 0.75 | 80 | 0.07 |
| EM-3 | 0.5 | 83 | 0.09 |
| EM-4 | 0.4 | 83 | 0.10 |
| EM-5 | 0.5 | 73 | 0.09 |
| EM-6 | 0.4 | 73 | 0.10 |

Each light-sensitive material were prepared by changing the coated amount of silver as listed in Table I ($g/m^2$: expressed in the amount of silver).

TABLE I

| Sample | EM-1 | EM-2 | EM-3 | EM-4 | EM-5 | EM-6 | Total |
|---|---|---|---|---|---|---|---|
| A | 0.30 | 0.30 | 0.10 | 0.20 | 0.10 | 0.30 | 1.30 |
| B | 0.20 | 0.20 | 0.10 | 0.20 | 0.10 | 0.20 | 1.00 |
| C | 0.15 | 0.15 | 0.10 | 0.20 | 0.10 | 0.20 | 0.90 |
| D | 0.20 | 0.20 | 0.10 | 0.15 | 0.05 | 0.15 | 0.85 |
| E | 0.15 | 0.20 | 0.10 | 0.15 | 0.05 | 0.15 | 0.80 |
| F | 0.15 | 0.15 | 0.10 | 0.15 | 0.05 | 0.15 | 0.75 |
| G | 0.15 | 0.15 | 0.05 | 0.15 | 0.05 | 0.15 | 0.70 |
| H | 0.13 | 0.13 | 0.05 | 0.11 | 0.07 | 0.16 | 0.65 |
| I | 0.12 | 0.12 | 0.05 | 0.10 | 0.05 | 0.16 | 0.65 |
| J | 0.10 | 0.10 | 0.05 | 0.10 | 0.05 | 0.15 | 0.55 |

The structural formulas of the compounds used are as follows:

ExY-1

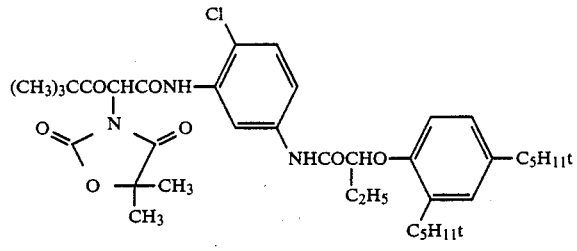

ExY-2

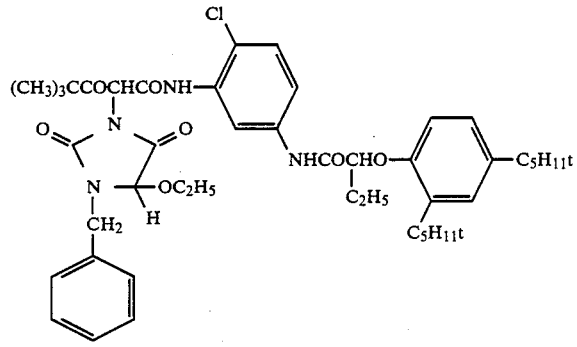

-continued
ExM-1
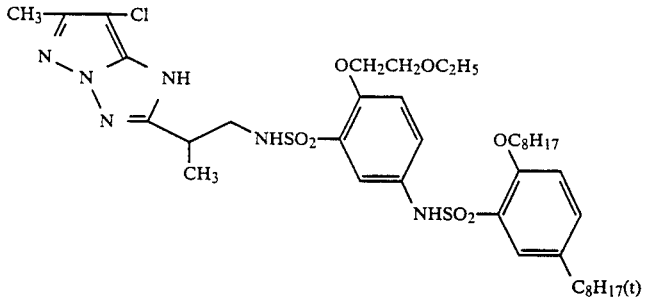
ExC-1
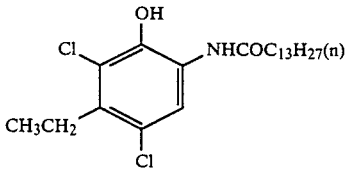
ExS-1
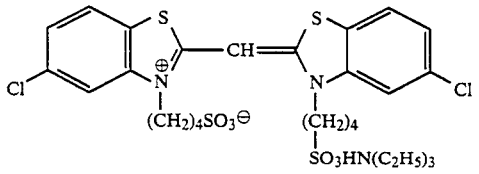
ExS-2
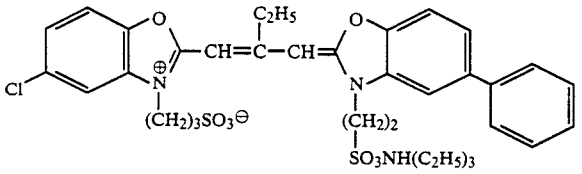
ExS-3
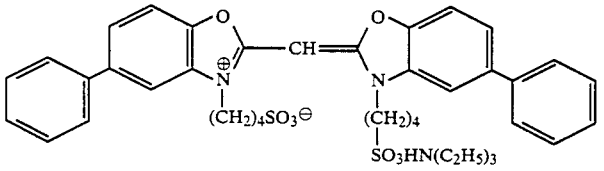
ExS-4
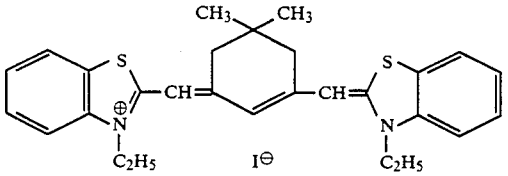
ExS-5
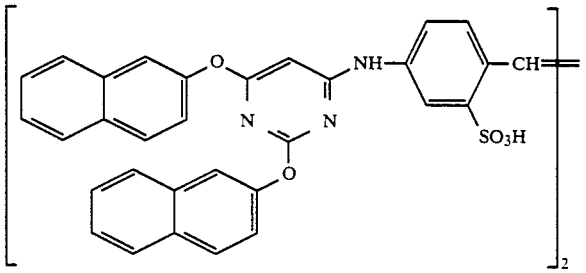

-continued
Cpd-1
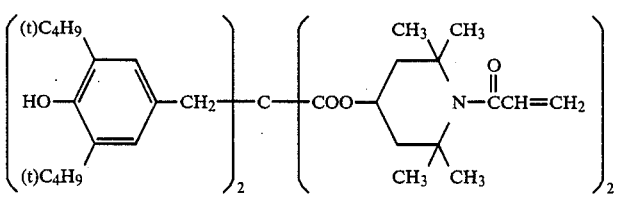
Cpd-2
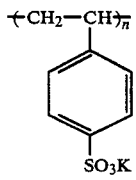
Cpd-3
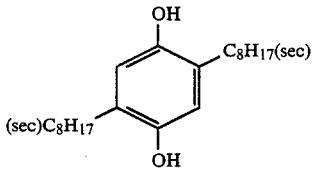
Cpd-4
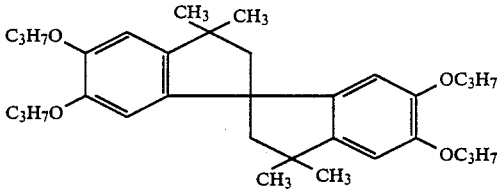
Cpd-5
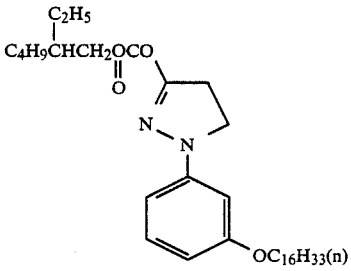
Cpd-6
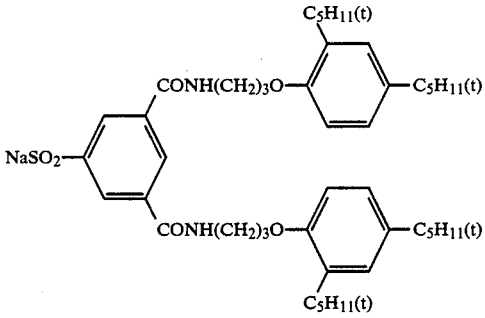
Cpd-7
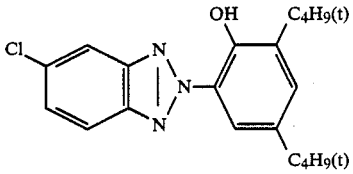

-continued
Cpd-8
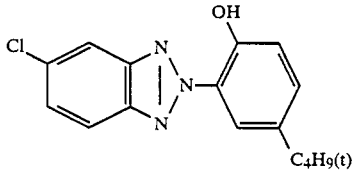
Cpd-9
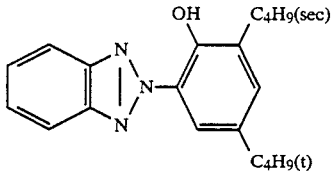
Cpd-10
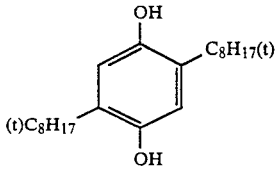
Cpd-11
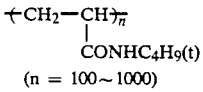
(n = 100~1000)
Cpd-12
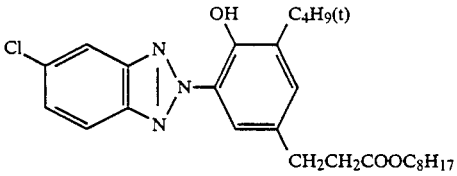
Solv-1: Dibutyl Phthalate
Solv-2: Tricresyl Phosphate
Solv-3: Trioctyl Phosphate
Solv-4: Trinonyl Phosphate
Cpd-13
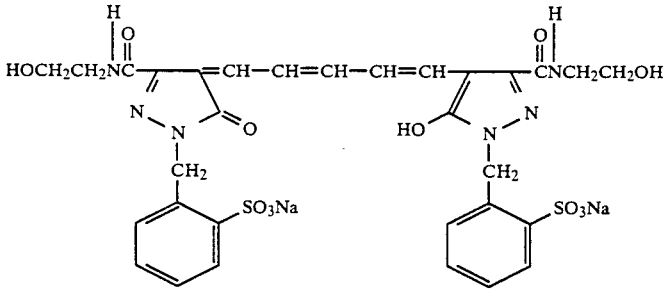
Cpd-14
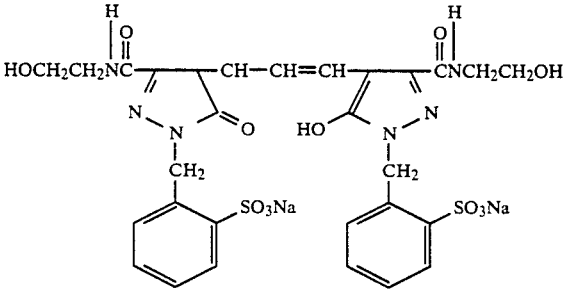

-continued

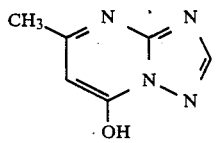

Cpd-15

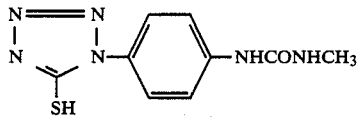

Cpd-16

The color photographic paper A to J thus prepared were exposed to light (250 CMS (candela meter second)) and then were processed in accordance with the following processes. In this respect, the concentrations of bleaching and fixing agents in the bleach-fixing solution were changed as shown in Table II.

| Process | Temp. (°C.) | time (sec.) |
|---|---|---|
| Color Development | 38 | 100 |
| Bleach-fixing | 30 to 34 | 20 |
| Rinse (1) | 30 to 34 | 20 |
| Rinse (2) | 30 to 34 | 20 |
| Rinse (3) | 30 to 34 | 20 |
| Drying | 70 to 80 | 50 |

Rinse was carried out by 3-stage countercurrent system from rinse (3) to rinse (1).

The composition of each processing solution is as follows:

| | |
|---|---|
| (Color Developer) | |
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Benzyl alcohol | 16 ml |
| Diethylene glycol | 10 ml |

-continued

| | |
|---|---|
| Sodium sulfite | 2.0 g |
| Potassium bromide | 0.5 g |
| Potassium carbonate | 30 g |
| N-Ethyl-N-(beta-methanesulfonamidethyl)-3-methyl-4-aminoaniline sulfate | 5.5 g |
| Hydroxylamine sulfate | 3.0 g |
| Fluorescent whitener (WHITEX 4; available from Sumitomo Chemical Company, Limited) | 1.5 g |
| Water ad. | 1,000 ml |
| pH | 10.25 (25° C.) |
| (Bleach-fixing Solution) | |
| Water | 400 ml |
| 70% Ammonium thiosulfate | (see Table II) |
| Sodium sulfite | 20 g |
| Ferric ammonium ethylenediaminetertaacetate | (see Table II) |
| Disodium ethylenediaminetetraacetate | 10 g |
| Water ad. | 1,000 ml |
| pH | 7.00 (25° C.) |
| (Rinse Solution) | |
| Benzotriazole | 1.0 g |
| Ethylenediamine-N,N,N',N'-tetramethylene-phosphonic acid | 0.3 g |
| Water ad. | 1,000 ml |
| pH | 7.50 (25° C.) |

The amount of the residual silver (expressed in the amount of elemental silver (microgram/cm$^2$)) was determined by fluorescent X-ray method and the results obtained were summarized in Table II.

TABLE II

| | Bleach-fixing Solution | | | Photographic Paper | | | |
|---|---|---|---|---|---|---|---|
| | | | | A | B | C | D |
| | | | | Amount of Silver | | | |
| | | | | 1.30 g/m$^2$ | 1.00 | 0.90 | 0.85 |
| Processing No. | Bleaching Agent (mol/l) | Fixing Agent (mol/l) | Remarks | Comparative Example | Comparative Example | Comparative Example | Comparative Example |
| 1 | 0.20 | 1.00 | Comparative Example | 31 | 27 | 24 | 20 |
| 2 | 0.15 | 1.00 | Comparative Example | 35 | 29 | 24 | 17 |
| 3 | 0.12 | 0.75 | Comparative Example | 40 | 31 | 25 | 14 |
| 4 | 0.10 | 0.75 | Comparative Example | 43 | 33 | 26 | 12 |
| 5 | 0.15 | 0.50 | Comparative Example | 47 | 35 | 26 | 10 |
| 6 | 0.10 | 0.50 | Present Invention | 51 | 37 | 25 | 7 |
| 7 | 0.08 | 0.45 | Present Invention | 57 | 39 | 30 | 8 |
| 8 | 0.08 | 0.40 | Present Invention | 63 | 40 | 33 | 8 |
| 9 | 0.07 | 0.40 | Present Invention | 67 | 45 | 36 | 10 |
| 10 | 0.07 | 0.35 | Present Invention | 73 | 57 | 38 | 15 |

| | Bleach-fixing Solution | | | Photographic Paper | | | | | |
|---|---|---|---|---|---|---|---|---|---|
| | | | | E | F | G | H | I | J |
| | | | | Amount of Silver | | | | | |
| | | | | 0.80 | 0.75 | 0.70 | 0.65 | 0.60 | 0.55 |
| Processing No. | Bleaching Agent (mol/l) | Fixing Agent (mol/l) | Remarks | Present Invention | Present Invention | Present Invention | Present Invention | Present Invention | Present Invention |
| 1 | 0.20 | 1.00 | Comparative Example | 20 | 19 | 19 | 18 | 18 | 18 |
| 2 | 0.15 | 1.00 | Comparative Example | 17 | 17 | 17 | 16 | 16 | 16 |
| 3 | 0.12 | 0.75 | Comparative Example | 15 | 15 | 14 | 14 | 14 | 14 |
| 4 | 0.10 | 0.75 | Comparative Example | 10 | 10 | 10 | 9 | 9 | 9 |
| 5 | 0.15 | 0.50 | Comparative Example | 7 | 8 | 8 | 8 | 7 | 7 |
| 6 | 0.10 | 0.50 | Present Invention | 5 | 4 | 3 | 3 | 3 | 3 |
| 7 | 0.08 | 0.45 | Present Invention | 3 | 3 | 1 | 1 | 1 | 1 |

TABLE II-continued

| | | | | | | | | | |
|---|---|---|---|---|---|---|---|---|---|
| 8 | 0.08 | 0.40 | Present Invention | 3 | 3 | 1 | 1 | 1 | 1 |
| 9 | 0.07 | 0.40 | Present Invention | 3 | 3 | 1 | 1 | 1 | 1 |
| 10 | 0.07 | 0.35 | Present Invention | 3 | 3 | 1 | 1 | 1 | 1 |

As seen from Table II, it is clear that the desilvering rate of the low silver light-sensitive materials (E to J) was enhanced by treating them with the bleach-fixing solutions (processing Nos. 6 to 10) of the invention. However, the desilvering rate of the light-sensitive materials (A to D) other than the present invention was reduced by using the bleach-fixing solution of this invention as conventionally known.

Example 2

The procedures of Example 1 were repeated except that ferric ammonium diethylenetriaminepentaacetate was used in place of ferric ammonium ethylenediaminetetraacetate as the bleaching agent and desilvering properties were likewise examined. As a result, extremely excellent desilvering properties were observed in the present invention.

Example 3

The procedures of Example 1 were repeated except that ferric ammonium cyclohexanediaminetetraacetate was used in place of ferric ammonium ethylenediaminetetraacetate as the bleaching agent and desilvering properties were likewise examined. As a result, extremely excellent desilvering properties were observed in the present invention.

Example 4

In the same manner as in the preparation of Sample H in Example 1, Samples K, L, M, N, O, P, Q and R were prepared except that the following compounds were used in place of the magenta coupler used in Example 1:

Sample K

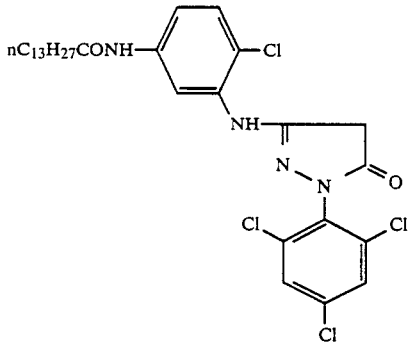

Sample L

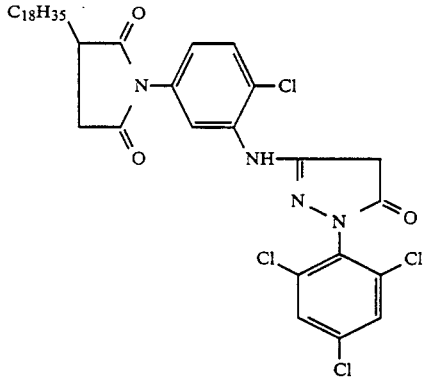

Sample M

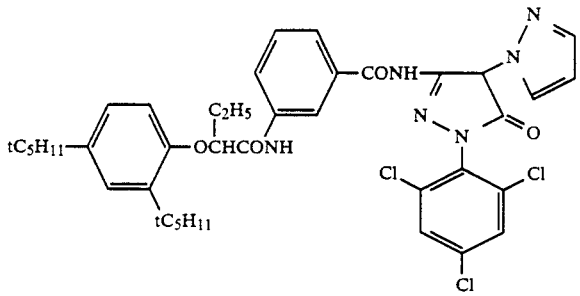

M-27

Sample N:

M-38

Sample O:

-continued

M-39 m-7 m-20

Then, Sample H was imagewise exposure to light and was subjected to running test in accordance with the following processes until the amount of the bleach-fixing solution replenished reached 2 times the volume of the bleach-fixing tank. The running tests were carried out using solutions differing in the concentrations of bleaching and fixing agents as shown in Table III.

| Process | Temp. (°C.) | Time (sec) | Amount Replenished (ml) | Tank Volume (liter) |
|---|---|---|---|---|
| Color Development | 38 | 100 | 290 | 17 |
| Bleach-fixing | 33 | 30 | 150 | 9 |
| Rinse (1) | 30–34 | 20 | — | 4 |
| Rinse (2) | 30–34 | 20 | — | 4 |
| Rinse (3) | 30–34 | 20 | 364 | 4 |
| Drying | 70–80 | 50 | | |

The amount replenished is expressed as that per 1 $m^2$ of the material.
The rinse was carried out by three-tank countercurrent system from rinse (3) to rinse (1).

The composition of each processing solution is as follows:

| Component | Tank Soln. | Replenisher |
|---|---|---|
| (Color Developer) | | |
| Water | 800 ml | 800 ml |
| Diethylenetriaminepentaacetic acid | 1.0 g | 1.0 g |
| Nitrilotriacetic acid | 2.0 g | 2.0 g |
| 1-Hydroxyethylidene-1,1-diphosphonic acid | 2.0 g | 2.0 g |
| Potassium bromide | 0.5 g | — |
| Potassium carbonate | 30 g | 30 g |
| N-Ethyl-N-(beta-methanesulfonamidethyl)-3-methyl-4-aminoaniline sulfate | 5.5 g | 7.5 g |
| N,N-Diethylhydroxylamine | 3.6 g | 5.5 g |
| Fluorescent whitener (WHITEX 4; available from Sumitomo Chemical Company, Limited) | 1.5 g | 2.0 g |
| Triethylenediamine-1,4-diazabicyclo(2,2,2)octane | 5.0 g | 5.0 g |
| Water | ad. 1000 ml | ad. 1000 ml |
| pH (at 25° C.) | 10.20 | 10.60 |
| (Bleach-fixing Solution) | | |
| Water | 400 ml | 400 ml |
| 70% Ammonium thiosulfate | (see Table III) | |
| Sodium sulfite | 20 g | 40 g |
| Ferric ammonium ethylenediaminetetraacetate | (see Table III) | |
| Disodium ethylenediaminetetraacetate | 5 g | 10 g |
| Water | ad. 1000 ml | ad. 1000 ml |
| pH (at 25° C.) | 6.70 | 6.30 |
| (Rinse Solution): Tank Soln. and Replenisher | | |
| Ion exchange water (Ca and Mg contents were not more than 3 ppm respectively). | | |

The concentrations of bleaching and fixing agents in each running equilibrated bleach-fixing solution were determined and summarized in Table III.

Samples K to R and H were exposed to ligth through a continuous tone wedge and then treated with each running equilibrated solution thus obtained. After processing, the residual amount of silver at Dmax area (area having maximum density) was determined by fluorescent X-ray method. In addition, magneta concentration of unexposed area (Dmin area) was determined. This was again determined after storing at 60° C./70% RH for one month. All these results are summarized in Table III.

TABLE III

| Processing No. | Processing (a) Bleaching Agent | (a) Fixing Agent | (b) Bleaching Agent | (b) Fixing Agent | (c) Bleaching Agent | (c) Fixing Agent | (d) Bleaching Agent | (d) Fixing Agent |
|---|---|---|---|---|---|---|---|---|
| Replenisher (mol/l) | 0.24 | 1.5 | 0.20 | 1.2 | 0.15 | 0.8 | 0.12 | 0.7 |
| Tank Soln. (mol/l) | 0.15 | 1.0 | 0.12 | 0.75 | 0.10 | 0.5 | 0.75 | 0.4 |
| Running Equilibrated Solution (mol/l) | 0.15 | 1.0 | 0.12 | 0.75 | 0.10 | 0.5 | 0.75 | 0.4 |

| Sample No. | | Color Photographic Paper: Comparative Example Amount of Silver ($\mu g/cm^2$) | $D_G$ After Processing | $D_G$ After Storage | Comparative Example Amount Silver ($\mu g/cm^2$) | $D_G$ After Processing | $D_G$ After Storage | Present Invention Amount of Silver ($\mu g/cm^2$) | $D_G$ After Processing | $D_G$ After Storage | Present Invention Amount of Silver ($\mu g/cm^2$) | $D_G$ After Processing | $D_G$ After Storage |
|---|---|---|---|---|---|---|---|---|---|---|---|---|---|
| K | Present Invention | 13 | 10.23 | 0.19 | 9 | 0.12 | 0.20 | 4 | 0.12 | 0.20 | 5 | 0.12 | 0 |
| L | Present Invention | 11 | 0.13 | 0.20 | 8 | 0.13 | 0.20 | 4 | 0.13 | 0.21 | 4 | 0.13 | 0 |
| M | Present Invention | 14 | 0.13 | 0.23 | 8 | 0.13 | 0.24 | 5 | 0.13 | 0.19 | 5 | 0.13 | 0 |
| N | Present | 13 | 0.12 | 0.25 | 7 | 0.12 | 0.25 | 2 | 0.13 | 0.19 | 2 | 0.12 | |

TABLE III-continued

| | | | | | | | | | | | | | |
|---|---|---|---|---|---|---|---|---|---|---|---|---|---|
| O | Invention Present | 12 | 0.12 | 0.27 | 8 | 0.12 | 0.26 | 3 | 0.13 | 0.18 | 3 | 0.13 | 0 |
| P | Invention Present | 12 | 0.12 | 0.27 | 8 | 0.12 | 0.26 | 3 | 0.12 | 0.18 | 3 | 0.12 | 0 |
| Q | Invention Present | 11 | 0.12 | 0.24 | 7 | 0.12 | 0.23 | 2 | 0.12 | 0.27 | 3 | 0.12 | 0 |
| R | Invention Present | 13 | 0.12 | 0.28 | 8 | 0.12 | 0.26 | 3 | 0.12 | 0.18 | 3 | 0.12 | 0 |
| H | Invention Present | 14 | 0.13 | 0.25 | 9 | 0.12 | 0.23 | 2 | 0.12 | 0.17 | 2 | 0.2 | 0 |

As seen from the results listed in Table III, it is found that the bleach-fixing solutions (processings c and d) of the invention exhibited excellent desilvering properties and made it possible to reduce the amount of residual silver. Moreover, the light-sensitive materials in which magenta couplers (I) or (II) were used (Samples N, O, P, Q, R and H) showed extremely low magenta stains even after processing and storage.

Example 5

Procedures of Example 4 were repeated except for using magenta couplers M-2, M-3, M-4, M-11, M-21, M-26, m-3, m-14, m-24 and m-25 and excellent effects in desilvering properties and resistance to the magemta stanis were likewise observed.

Example 6

Samples of photographic paper were prepared by applying, in order, 1st layer (lowest layer) to 7th layer (top layer) having the compositions as listed in Table C onto a paper substrate of which both sides had been laminated with polyethylene films and which had been treated by corona discharge. Each coating solution was prepared as follows. The details of structural formulas of couplers, dye image stabilizers and the like will be given below.

The coating solution for 1st layer was prepared as follows. A mixture of 200 g of an yellow coupler, 93.3 g of discoloring inhibitor (r), 10 g of a high boiling solvent (p), 5 g of a solvent (q) and 600 ml of ethyl acetate as an auxiliary solvent was heated at 60° C. to dissolve the compounds and the resulting solution was admixed with 3300 ml of 5% aqueous gelatin solution containing 330 ml of 5% aqueous solution of Alkanol B (trade mark of alkylnaphthalene sulfonate; available from Dupont Co., Ltd). Then, the mixture was emulsified with a colloid mill to form a coupler dispersion. Ethylacetate in the dispersion was evaporated off under reduced pressure. The resultant dispersion was added to 1,400 g of an emulsion (corresponding to 96.7 g of silver; containing 170 g of gelatin) to which a sensitizing dye for blue-sensitive emulsion and 1-methyl-2-mercapto-5-acetylamino-1,3,4-triazole had been added, and then 2,600 g of 10% aqueous gelatin solution was added thereto to form the intended coating solution Coating solutions for 2nd to 7th layers having the compositions shown in Table C were prepared in the similar manner.

In each 3rd layer of the photographic papers, the magenta coupler shown in Table 4 was used.

TABLE C

| Layer | Components | |
|---|---|---|
| 7th Layer (Protective Layer) | Gelatin | 600 mg/m$^2$ |
| 6th Layer (UV Absorbing Layer) | UV absorber (n) | 260 mg/m$^2$ |
| | UV absorber (o) | 70 mg/m$^2$ |

TABLE C-continued

| Layer | Components | |
|---|---|---|
| | Solvent (p) | 300 mg/m$^2$ |
| | Solvent (q) | 100 mg/m$^2$ |
| | Gelatin | 700 mg/m$^2$ |
| 5th Layer (Red-sensitive Layer) | Silver chlorobromide emulsion (AgBr = 1.0 mole %) | 210 mg/m$^2$ |
| | Cyan coupler | $5 \times 10^{-4}$ M/m$^2$ |
| | Discoloring inhibitor (r) | 250 mg/m$^2$ |
| | Solvent (p) | 160 mg/m$^2$ |
| | Solvent (q) | 100 mg/m$^2$ |
| Layer (Color Gelatin | 1800 mg/m$^2$ | |
| 4th Layer(Color Mixing Inhibiting Layer) | Color mixing inhibitor (s) | 65 mg/m$^2$ |
| | UV absorber (n) | 450 mg/m$^2$ |
| | UV absorber (o) | 230 mg/m$^2$ |
| | Solvent (p) | 50 mg/m$^2$ |
| | Solvent (q) | 50 mg/m$^2$ |
| | Gelatin | 1700 mg/m$^2$ |
| 3rd Layer (Green-sensitive Layer) | Silver chlorobromide emulsion (AgBr = 0.5 mole %) | 250 mg/m$^2$ |
| | Magenta coupler (see Table IV) | 670 mg/m$^2$ |
| | Discoloring inhibitor (t) | 150 mg/m$^2$ |
| | Discoloring inhibitor (u) | 10 mg/m$^2$ |
| | Solvent (p) | 200 mg/m$^2$ |
| | Solvent (q) | 10 mg/m$^2$ |
| | Gelatin | 1400 mg/m$^2$ |
| 2nd Layer (Color Mixing Inhibiting Layer) | Silver bromide emulsion (not post-ripened; grain size = 0.05 micron) | 10 mg/m$^2$ (Ag) |
| | Color mixing inhibitor (s) | 55 mg/m$^2$ |
| | Solvent (p) | 30 mg/m$^2$ |
| | Solvent (q) | 15 mg/m$^2$ |
| | Gelatin | 800 mg/m$^2$ |
| 1st Layer (Blue-sensitive Layer) | Silver chlorobromide emulsion (AgBr = 1.0 mole %) | 230 mg/m$^2$ |
| | Yellow coupler | 600 mg/m$^2$ |
| | Discoloring inhibitor (r) | 280 mg/m$^2$ |
| | Solvent (p) | 30 mg/m$^2$ |
| | Solvent (q) | 15 mg/m$^2$ |
| | Gelatin | 1800 mg/m$^2$ |
| Substrate | Paper substrate of which both sides had been laminated with polyethylene films. | |

Compounds used in this Example were as follows:

| | |
|---|---|
| UV Absorber (n) | 2-(2-hydroxy-3,5-di-tert-amylphenyl)-benzotriazole; |
| UV Absorber (o) | 2-(2-hydroxy-3,5-di-tert-butylphenyl)-benzotriazole; |
| Solvent (p) | di-(2-ethylhexyl)-phthalate; |
| Solvent (q) | dibutyl phthalate; |
| Discoloring inhibitor (r) | 2,5-di-tert-amylphenyl-3,5-di-tert-butylhydroxybenzoate; |
| Color mixing inhibitor (s) | 2,5-di-tert-octylhydroquinone; |

-continued

| | |
|---|---|
| Discoloring inhibitor (t) | 1,4-di-tert-amyl-2,5-di-octyl-oxybenzene; |
| Discoloring inhibitor (u) | 2,2'-methylene-bis(4-methyl-6-tert-butylphenol; |
| In each emulsion layer, the following compound was used as a sensitizing dye: | |
| Blue-sensitive Emulsion Layer | anhydro-5-methoxy-5'-methyl-3,3'-disulfopropylselenacyanine hydroxide |
| Green-sensitive Emulsion Layer | anhydro-9-ethyl-5,5'-diphenyl-3,3'-disulfoethyloxacarbocyanine hydroxide |
| Red-sensitive Emulsion Layer | 3,3'-diethyl-5-methoxy-9,9'-(2,2-dimethyl-1,3-propano)-thiadicarbocyanine iodide. |

In addition, 1-methyl-2-mercapto-5-acetylamino-1,3,4-triazole was used as a stabilizer in each emulsion layer.

The following compounds were used as an irradiation inhibiting dye:

Dipotassium 4-(3-carboxy-5-hydroxy-4-(3-(3-carboxy-5-oxo-1-(4-sulfonatophenyl)-2- pyrazolin-4-ylidene)-1-propenyl)-1-pyrazolyl)-benzenesulfonate; and Tetrasodium N,N'-(4,8-dihydroxy-9,10-dioxo-3,7-disulfonatoanthracene-1,5-diyl)-bis(aminomethanesulfonate).

1,2-Bis(vinylsulfonyl)-ethane was used as a film hardening agent.

Couplers used were as follows:

Yellow Coupler:

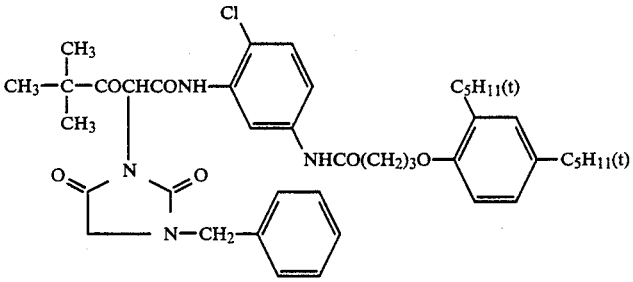

Magenta Coupler: (see Table IV)

Cyan Coupler:

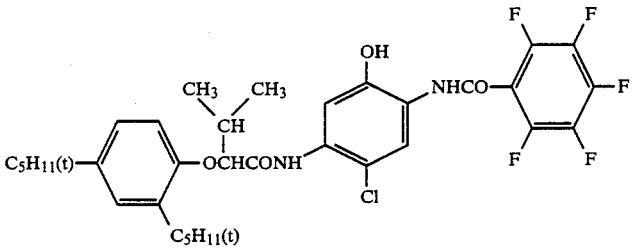

and

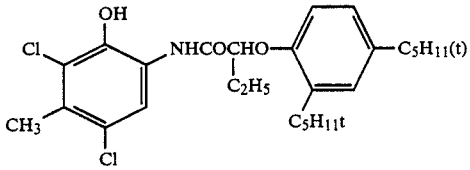

(molar ratio = 1:1)

The multilayered color photographic paper thus prepared were exposed to light and then processed in accordance with the following processes:

| Process | Temp. (°C.) | Time (sec.) |
|---|---|---|
| Color Development | 35 | 45 |
| Bleach-fixing | 35 | 30 |
| Rinse (1) | 35 | 30 |
| Rinse (2) | 35 | 30 |
| Rinse (3) | 35 | 30 |
| Drying | 60–70 | 50 |

Rinse was carried out by three-tank countercurrent system rinse (3) to rinse (1).

The composition of each tank solution used was as follows:

| | Tank Soln. |
|---|---|
| (Color Developer) | |
| Triethanolamine | 10 ml |
| N,N-Diethylhydroxylamine | 4.0 g |
| Fluorescent whitener (4,4'-diaminostilbene type) | 3.0 g |
| Ethylenediamine-N,N,N',N'-tetramethylene-phosphonic acid | 1.0 g |
| Potassium carbonate | 30.0 g |
| Sodium chloride | 1.4 g |
| 4-Amino-3-methyl-N-ethyl-N-(beta-(methane-sulfonamide)-ethyl)-aniline sulfate | 5.0 g |
| Sodium sulfite | 0.1 g |
| 1,2-Dihydroxybenzo-3,4,6-trisulfonic acid | 300 mg |
| Water ad. | 1000 ml |
| pH | 10.10 |

-continued

| | Tank Soln. |
|---|---|
| (Bleach-fixing Solution) | |
| The running equilibrated solutions (a to d) obtained in Example 5 were used. | |
| (Rinse Solution): Tank Soln. and Replenisher | |
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| 40% Bismuth chloride solution | 0.5 g |
| 40% Nitrilo-N,N,N-trimethylenephosphonic acid | 1.0 g |
| 60% 1-Hydroxyethylidene-1,1-diphosphonic acid | 2.5 g |
| Fluorescent whitener (4,4'-diaminostilbene type) | 1.0 g |
| 26% Aqueous ammonia | 2.0 ml |
| Water ad. | 1000 ml |
| pH (adjusted with KOH) | 7.5 |

As in Example 5, the light-sensitive materials differing in magenta couplers used were processed in accordance with the foregoing processes in which different bleach-fixing solutions were used and the amount of residual silver and the degree of magenta stains were determined for each light-sensitive material. The results obtained are summarized in Table IV.

TABLE IV

| Light-sensitive Material | | Bleach-fixing Solution (a) Comparative Example | | | Bleach-fixing Solution (b) Comparative Example | | |
|---|---|---|---|---|---|---|---|
| | | Amount of Silver | $D_G$ | | Amount of Silver | $D_G$ | |
| No. | Magenta Coupler | ($\mu g/cm^2$) | After Processing | After Storage | ($\mu g/cm^2$) | After Processing | After Storage |
| S | Same as Sample K | 16 | 0.14 | 0.18 | 13 | 0.14 | 0.18 |
| T | Same as Sample L | 17 | 0.14 | 0.17 | 14 | 0.14 | 0.17 |
| U | Same as Sample M | 17 | 0.14 | 0.20 | 13 | 0.14 | 0.20 |
| V | M-27 | 18 | 0.14 | 0.23 | 11 | 0.14 | 0.23 |
| W | M-38 | 18 | 0.14 | 0.23 | 12 | 0.14 | 0.22 |
| X | M-39 | 17 | 0.14 | 0.23 | 12 | 0.14 | 0.22 |
| Y | m-7 | 16 | 0.14 | 0.22 | 12 | 0.14 | 0.21 |
| Z | m-20 | 17 | 0.14 | 0.23 | 13 | 0.14 | 0.21 |

| Light-sensitive Material | | Bleach-fixing Solution (c) Present Invention | | | Bleach-fixing Solution (d) Present Invention | | |
|---|---|---|---|---|---|---|---|
| | | Amount of Silver | $D_G$ | | Amount of Silver | $D_G$ | |
| No. | Magenta Coupler | ($\mu g/cm^2$) | After Processing | After Storage | ($\mu g/cm^2$) | After Processing | After Storage |
| S | Same as Sample K | 5 | 0.14 | 0.18 | 5 | 0.13 | 0.18 |
| T | Same as Sample L | 6 | 0.13 | 0.17 | 5 | 0.13 | 0.17 |
| U | Same as Sample M | 5 | 0.13 | 0.17 | 5 | 0.13 | 0.17 |
| V | M-27 | 4 | 0.13 | 0.17 | 3 | 0.13 | 0.16 |
| W | M-38 | 3 | 0.13 | 0.17 | 3 | 0.13 | 0.16 |
| X | M-39 | 4 | 0.13 | 0.18 | 3 | 0.13 | 0.16 |
| Y | m-7 | 4 | 0.13 | 0.17 | 3 | 0.13 | 0.17 |
| Z | m-20 | 3 | 0.13 | 0.17 | 3 | 0.13 | 0.17 |

As seen from Table IV, it is found that the bleach-fixing solutions (c and d) of the invention were excellent in desilvering properties and made it possible to extremely reduce the amount of residual silver. In particular, the light-sensitive materials (V to Z) in which magemta couplers (I) or (II) were used exhibited noticeably low magemta stains after processing and storage.

What is claimed is:

1. A method for processing a silver halide color photographic light-sensitive material which comprises color developing a silver halide color photographic light-sensitive material, the coating amount of silver thereon being not more than 0.8 g/m$^2$, bleach-fixing the developed material and then water washing and/or stabilizing the bleach-fixed material, wherein the method further comprises that the total concentration of bleaching agent(s) in a bleach-fixing solution is not more than 0.1 mole/1 and the total concentration of fixing agent(s) in the solution is not more than 0.50 mole/1.

2. A method for processing a light-sensitive material according to claim 1 wherein the amount of replenished liquid for washing water and/or stabilization solution is 3 to 50 times the volume of liquid carried over from the bath preceding the water washing and/or the stabilization bath.

3. A method for processing a light-sensitive material according to claim 1 wherein said light-sensitive material contains at least one magenta coupler represented by the following general formula (I) or (II):

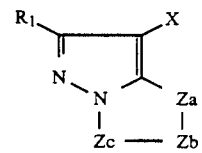

(I)

wherein $R_1$ represents a hydrogen atom or a substituent; X represents a hydrogen atom or a group which may be eliminated through a coupling reaction with an oxidized form of an aromatic primary amine developing agent; Za, Zb and Zc represent a methine, a substituted methine, =N—or —NH—, provided that one of the bonds Za—Zb and Zb—Zc is a double bond and the other is a single bond, that when Zb—Zc bond is a carbon-carbon double bond, Zb—Zc may be a part of an aromatic ring, that a dimer or a higher polymer may be formed through $R_1$ or X and that when Za, Zb or Zc is a substituted methine, a dimer or a higher polymer may be formed through the substituted methine:

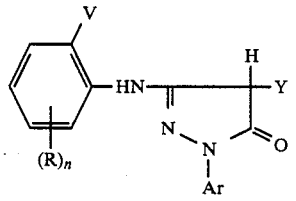

(II)

wherein Ar is a phenyl group which may be substituted; Y represents a group eliminated when the coupler causes coupling reaction with an oxidized form of an aromatic primary amine developing agent to form a dye; V is a halogen atom, an alkoxy group or an alkyl group; R represents a group which may be substituted for a hydrogen atom on a benzene ring; and n is an integer of 1 or 2; provided that when n is 2, two substituents R may be the same or different.

4. A method for processing a light-sensitive material according to claim 1 wherein the coating amount of silver ranges from 0.20 to 0.50 g/m$^2$.

5. A method for processing a light-sensitive material according to claim 1 wherein the silver halide contained in the light-sensitive material is silver chloride or silver chlorobromide.

6. A method for processing a light-sensitive material according to claim 1 wherein the concentration of the bleaching agents in the bleach-fixing solution ranges from 0.05 to 0.08 mole/1.

7. A method for processing a light-sensitive material according to claim 1 wherein the concentration of the fixing agents in the bleach-fixing solution ranges from 0.2 to 0.45 mole/1.

8. A method for processing a light-sensitive material according to claim 1 wherein the concentration of the bleacing agents in the bleach-fixing solution is not more than 0.1 mole/1 and that of the fixing agents is not more than 0.50 mole/1.

9. A method for processing a light-sensitive material according to claim 1 wherein the concentrations of the bleaching agents and fixing agents in the bleach-fixing solution are 0.05 to 0.08 mole/1 and 0.2 to 0.45 mole/1, respectively.

* * * * *